United States Patent [19]

Nilsson

[11] Patent Number: 4,763,504

[45] Date of Patent: Aug. 16, 1988

[54] STRAIGHTENING MACHINES AND METHODS

[76] Inventor: Einar W. Nilsson, 705 Curtin St., Bellefonte, Pa. 16823

[21] Appl. No.: 76,791

[22] Filed: Jul. 23, 1987

Related U.S. Application Data

[60] Division of Ser. No. 659,087, Oct. 10, 1984, Pat. No. 4,711,112, which is a continuation-in-part of Ser. No. 280,372, Jul. 6, 1981, Pat. No. 4,494,394.

[51] Int. Cl.[4] ..... B21D 3/04

[52] U.S. Cl. ..... 72/98; 72/99

[58] Field of Search ..... 72/98, 99

[56] References Cited

U.S. PATENT DOCUMENTS 2,556,120 6/1951 Sutton ..... 72/98

3,780,558 12/1973 Lilienthal et al. ..... 72/98

FOREIGN PATENT DOCUMENTS 2040763 9/1980 United Kingdom ..... 72/98

*Primary Examiner*—Lowell A. Larson

*Attorney, Agent, or Firm*—Reed Smith Shaw & McClay

[57] ABSTRACT

A cross-roll straightener adapted to straighten round metal stock, wire, rods, bars and tubes by rotatingly advancing the stock through a central curved pass such that it is flexed beyond the yield point in a substantially uniform and gradual manner. A three pair roll arrangement provides uniform guidance and flexure while avoiding marking or collapsing of the stock. Also provided is a method for maintaining the stock in the pass line of a cross-roll straightener having a female roll and a male roll of unequal diameters. In addition, positive guidance and considerably more capacity to straighten smaller stock sizes is obtained by providing adjustable outboard roll supports at each end of the basic six-roll straightener, thereby also reducing whipping of the stock.

20 Claims, 15 Drawing Sheets

STRAIGHTENING MACHINES AND METHODS

RELATION TO OTHER APPLICATIONS

This application is a divisional of co-pending application Ser. No. 659,087 filed on Oct. 10, 1984, now U.S. Pat. No. 4,711,172 granted Dec. 8, 1987, which was a continuation-in-part of then pending application Ser. No. 280,372, entitled "Straightening Machines and Methods", filed on July 6, 1981, which issued as U.S. Pat. No. 4,494,394 on Jan. 22, 1985.

FIELD OF THE INVENTION

The present invention is an improved cross-roll straightener that straightens round metal stock, wire, rods, bars, and tubes, by rotatingly advancing the stock through a curved pass such that it is flexed beyond the yield point in a substantially uniform manner. The invention also provides a method for maintaining the stock in the pass line of a cross-roll straightener.

BACKGROUND OF THE INVENTION

Metal stock, such as wire, rods, bars and tubes, is formed by rolling, drawing and otherwise shaping the metal both while it is at elevated temperature and after it has cooled. The metal stock cools and cures in a heterogeneous manner such that a degree of warpage and curvature typically develops in the stock.

In the prior art, the stock has been straightened in machines known as cross-roll straighteners. Typically, such machines include one or more pairs of rolls that are disposed in skewed relation and spaced apart from each other. The space between the member rolls of each pair is called a "pass". Where more than one roll pair is used the roll pairs are adjacently arranged such that the "passes" of the roll pairs collectively define a "pass line" along which the stock travels through the cross-roll straightener. At least one of the rolls of each pair are rotatingly driven such that the stock is rotatingly advanced therebetween along the pass line.

In order to straighten the stock, conventional cross-roll straighteners generally apply a concentrated central load between supports to stress the stock beyond its yield point. Such concentrated central loads produce a peak bending moment that is applied in the shape of a helix on the surface of the stock as it rotatingly advances through the machine. Unfortunately, such a peak bending moment nonuniformly flexes the stock such that it is not evenly straightened.

Cross-roll straighteners of the prior art have many work roll arrangements that include various numbers of work rolls. For example, 2-roll straighteners of the prior art generally form a curved pass between a straight or convex roll and a roll having a concave contour. The straight or convex roll deforms the stock against the concave roll. However, such 2-roll straighteners require complex guides to maintain the stock in the roll pass, and have a limited capacity in straightening various sizes and materials.

An improvement in 2-roll straighteners is described in U.S. Pat. No. 3,047,046 in which a concave male roll is located on the convex side of the curved pass and is smaller in diameter than the female roll. Both rolls are contoured so that the stock is wedged between the rolls at the ends of the pass and thereby maintained in the curved pass without guides. The central portion of the curved pass in the straighteners of U.S. Pat. No. 3,047,046 has a substantially parabolic curvature such that the bending moment on the stock is substantially that of a uniformly loaded beam. However, because both rolls were concave and were contoured to contact the stock throughout the curved pass, a relatively large roll angle change for the female roll was required whenever a different diameter stock was straightened. Specifically the roll angle adjustment for the female roll is much greater than the corresponding adjustment for the male roll. Consequently, excessive slippage between the two rolls and the stock occurred for certain stock sizes and materials where the opposed roll had substantially different contact angles with the stock.

In cross-roll straighteners having more than two work rolls, the rolls are generally arranged in a plurality of cross-roll pairs, each forming a straight pass. The cross-roll pairs are arranged in laterally offset fashion so as to flex the stock as it advances along the pass line. Such arrangements have generally been found to be faster and more efficient than 2-roll straighteners. Typical examples are 5-roll and 6-roll straighteners. Conventional 5-roll straighteners have two pairs of cross-rolls and an intermediate single bending roll. Such 5-roll straighteners generally provide greater leverage for bending the stock than a single curved pass 2-roll straightener. However, 5-roll straighteners also require additional guides to maintain the stock in proper position as it passes through the machine.

Conventional 6-roll straighteners have three pairs of cross-rolls of equal diameter that form straight passes. The pass line is defined by a central pass that is laterally offset from the line between the end passes. As the stock moves along the pass, it is flexed between the central roll pair and supported by the two end roll pairs in a manner similar to a simple beam having a single load between two supports. 6roll straighteners can generally be operated at higher speeds and without guides. 6-roll straighteners have generally been used for straightening tubular stock of small diameter and medium to low strength material.

However, these straighteners have required a longer bending span than 5-roll straighteners and, therefore, cannot uniformly flex all stock sizes to a minimum radius of curvature as required to flex most of each section to or beyond the yield point of the material. Some restraining action on the stock occurs in the endroll passes, as evidenced by the smaller slope of stock deflection at the ends of such straighteners. However, this restraining action is insufficient to provide effective reverse bends for all portions of the stock, or to eliminate problems with the tables, particularly the outlet end table. Such moderate restraining action on the stock, together with the lack of guidance in the roll pairs, does not produce sufficient uniform flexure for good straightening and also limits the stock capacity of the machine and the throughput speed of the stock. Another problem has been that the passes in conventional 6-roll straighteners do not provide positive guidance for the stock.

Because of the longer bending span, non-uniform flexure, and poor guidance of the stock, prior multiple pair cross-roll straighteners were much less effective in straightening the stock than 2-roll straighteners. In particular, the female roll of the central roll pair had a symmetrical roll contour that did not conform to the surface of flexed stock. The concentrated bending loads also resulted in concentrated roll pressure on tubular stock that is sufficient to oval thin wall tubular sections.

Prior attempts have been made to achieve more uniform distribution of the straightening loads in crossroll straighteners, particularly for applications involving larger diameter tubing having a relatively thin wall. The examples of such prior art, as shown in U.S. Pat. Nos. 2,376,401; 2,757,707; and 3,008,510, however, have a straight central roll pass that interferes with the curved, flexed stock.

In the prior art, rolls having various multi-sectional contours have been developed to improve the flexure of the stock and the machine capacity or straightening various stock sizes and materials. For example, U.S. Pat. No. 4,056,958 includes a roll having a two-section curvature defined by hyperboloids. However, since the contour is not symmetrical, there rolls cannot be used to flex and straighten a large variety of stock sizes and materials. U. S. Pat. No. 2,655,194 describes a roll having a contour with five sections wherein the outer sections are used for straight passes of the stock, the central section is defined by a cylinder of smaller diameter than the outer sections, and the intermediate sections are portions of circular cones. The central section is used to form a curved pass for straightening smaller stock sizes. The intermediate sections are selected so that the roll can be manufactured in a single set up with a specially contoured grinding wheel. The problem with such multi-sectional contoured female rolls has been that they do not provide a curved pass for a broad range of stock sizes and, particularly, for larger stock sizes. Furthermore, they generally do not provide a curved pass for smaller stock of high strength material. In the prior art, straightening stock in a curved pass has required different roll angle settings for the female roll and the male roll. The large difference in roll angle settings required to straighten small diameter or high strength stock as well as larger stock sizes in the same pair of rolls has greatly limited the capacity of conventional curved pass straighteners.

Other difficulties also existed with the prior art cross-roll straighteners. For example, in roll angling mechanisms such as shown in U.S. Pat. No. 3,604,236, the yoke tended to slip during the straightening operation so that the roll support would move axially after the angling screws were tightened. Other mechanisms tended to vary due to play in the adjustment screw threads or gears. In conventional 6-roll straighteners, angling of the rolls was somewaht cumbersome in that it required adjustment of twelve handwheels to angle and lock the rolls in position.

As another example, the roll brackets were expensive and difficult to maintain. In removing the rolls, bearing caps had to be removed and retainer screws loosened, thus exposing the bearing. In order to obtain accurate axial roll adjustment, bearing retainers had to be loosened and shims added or removed.

As still another example, the main frames of conventional straighteners such as shown in U.S. Pat. Nos. 3,540,251 and 3,604,236 absorb moments from lateral forces at the top or bottom of loosely fitted tie rods that are deflected by lateral forces and vibrations. The tie rods are weakest where the moment is greatest and the restraining moments in the upper plate and the base are excessive due to the short distance of restraint.

Accordingly, to provide higher operating speeds and improved straightening through uniform flexure, there was a need in the prior art for a straightener having the advantages of a curved pass 2-roll straightener but with greater straightening leverage and better guidance, such as found in 5 and 6-roll straighteners. In addition, there was a need for female roll suitable for use in a curved pass, but having a concave contour that would avoid excessive slippage between the rolls and stock for a broad range of stock sizes and materials.

SUMMARY OF THE INVENTION

In accordance with the present invention, stock is flexed in a curved pass to a minimum radius of curvature at which the stock is stressed beyond the yield point while the straightening loads are distributed more uniformly throughout the length of the curved pass. As the stock advances in rotary motion, it is positively guided in the curved pass and flexed to a minimum radius of curvature for at least one pitch of its surface, helical motion such that the stock is stressed in a substantially uniform manner.

Preferably, the female roll forming one side of the curved pass includes a central portion having an abrupt concave curvature and end portions that have a less abrupt curvature. The end portions of the roll are for straightening larger sizes of stock, and the central portion for straightening, by more abrupt flexure, smaller stock sizes or stronger materials. Thus considerably less variation is required in the female roll angles.

Preferably, the straightener includes three sets of cross-rolls with the central set laterally offset with respect to the other sets to increase or decrease the flexure of the stock as required while it is advanced in rotary motion by said rolls. Preferably, the rolls of the central roll pair are of unequal roll diameters to provide positive guidance of the stock. The rolls maintain the stock in the curved pass during the straightening operation and provide better guidance for both the leading and trailing ends of the stock as it enters and leaves the central pass. The central roll pair forms a curved pass that guides and complements the stock's flexure rather than merely applying a central load as in the prior art. Preferably, the flexure of the stock can be further improved by providing reverse flexures of the stock outside the curved pass as, for example, by outward adjustment or offset of the smaller, lower outer work rolls.

Preferably, concave cradle rolls are provided at each end of the cross-roll straightener to continuously bend the smaller stock sizes in reverse flexures during its forward, rotary motion, thus providing greater leverage for straightening a larger range of stock sizes and materials. The inlet and outlet cradle rollers also position the stock in the pass line and substantially reduce whipping of stock that is crooked or has end hooks, thereby permitting substantially higher operating speeds. At the outlet end, the leading end of the stock may be deflected in generally horizontal direction, to protect the trough and rolls of the outlet table. The curved pass cradle roller assembly is comprised of generally inversely symmetrical twin rolls that provide a bending yoke between 3-roll clusters or between two cross-roll passes. When used as a bending yoke, the cradle rolls have an unsymmetrical contour and are arranged in reverse symmetry about their common central axis such that only half of each roll contour contacts the stock under flexure. In another application, the two-roll bending yoke can be combined with an opposed female roll to act as a single bending cluster. In this embodiment, the bending yoke is adjusted with respect to the female roll for stock size and flexure. In an alternative embodiment, the 3-roll cluster is used as a bending cluster in combination with two adjacent 3-roll clusters. The 3-roll bending cluster is adjusted vertically in relation to the adjacent 3-roll clusters to augment the flexure obtained by the central bending rolls toward the bottom rolls of the adjacent 3-roll clusters. The twin-roll bending yoke comprised of rolls modified according to the subject invention can replace the single conventional bending roll of a conventional 5-roll straightener to great advantage, providing better guidance and better control of the stock's flexure while maintaining its smaller bending span and shorter roll center distances.

The preferred roll brackets allow for angular adjustments of adjacent rolls spaced at relatively small center-distances by arranging supports for the rolls in reverse symmetry about each roll's axis in such a way that stronger sections of each bracket will absorb torque produced by its roll. Therefore, increased bearing capacity is provided for rolls spaced at given center-distance by providing more space for the bearings on near sides of adjacent bracket ends, than provided in prior roll brackets.

The roll bracket construction also admits to rapid axial adjustment of the rolls by accessible adjusting screws to correct for inaccurate bracket machining and to compensate for rolls that are machined or worn off center.

Also the upper roll adjusting screws, preferably, are compactly preloaded in their respective screw box by adjustment of a spring loaded screw. Thus, the roll support will not move after the angling screws are tightened and will not sag when the angling mechanism is released or operated. The lower, central adjusting screw and the lower end rolls and their yokes are provided with hydraulically supported seats.

Especially on large machines, the roll angling mechanisms used for angling and locking the rolls include hydraulic cylinders and a single handwheel nut which limits 35 the angular movement in only one direction.

Preferably, the drive includes a gear box for one or more roll spindles in response to a variable speed motor. Also preferably, the drive mechanism includes a single variable speed motor for each roll drive, the motor being mounted on the same side of the gear box as the universal joint spindles. Alternatively, one variable speed motor can be provided for each gear box, one driving the upper end rolls and the other driving the lower end rolls. A third variable speed motor is provided that drives the central roll pair through a geared differential, having two output shafts that each drive one roll of the central roll pair.

Also the drive for the larger diameter roll in the 2-roll straightener, preferably, includes a clutch and a brake for temporarily reducing the surface velocity of the larger roll such that, after the stock has entered the pass, the surface velocity of the larger roll will be substantially equal to the surface speed of the smaller roll.

Other details, objects and advantages of the invention will become apparent as the following description of certain presently preferred embodiments and certain presently preferred methods of practicing the same proceeds.

BRIEF DESCRIPTION OF THE DRAWINGS

The accompanying drawings show certain presently preferred embodiments of the subject invention and illustrate presently preferred methods of practicing the same in which:

Figure 6 shows an end view of the main frame.

FIG. 33 is another view of the embodiment illustrated in FIG. 32.

PREFERRED EMBODIMENT OF THE INVENTION

A preferred embodiment of the subject invention is shown in FIGS. 1–7. The cross-roll straightener therein disclosed has a main frame including a main base 50 with integral extensions 52, 54 and 56 that are machined at the top. The main frame also includes main top plate 58 with integral extensions 60, 62 and 64, that are machined at the bottom to match main base extensions 52, 54 and 56. Extensions 52, 54 and 56 are fastened to extensions 60, 62 and 64. Preferably, one or more bolts are provided for fastening each extension 52–60, 54–62, and 56–64 with at least one bolt in two of said extensions being body bound in order to accurately position the top plate on the main base and absorb the lateral forces or shear between the top plate and the main base. Alternatively, dowels or tongue and groove members may be used in place of body bound bolts and the joints can also be hinged.

The largest moments due to lateral forces and vibrations in the main frame occur at the solid connections of extensions 52-56 and 60-64 to the main base 50 and top plate 58 while the moment at the midpoint connections 52-14 60, 54-14 62 and 56-14 64 is substantially zero. Thus the moments produced by shear forces are absorbed by the solid and integrally connected extensions at their strongest section. The bolts securing the upper and lower extensions are relatively short and comprised of high strength material. The short length of the bolts helps reduce the elongation cuased by the separating forces of the roll loads during the straightening operation. The body bound bolts withstand the shear forces transferred from the main top plate to the main base without slippage. Preferably, the bolts are preloaded.

Figure 2:
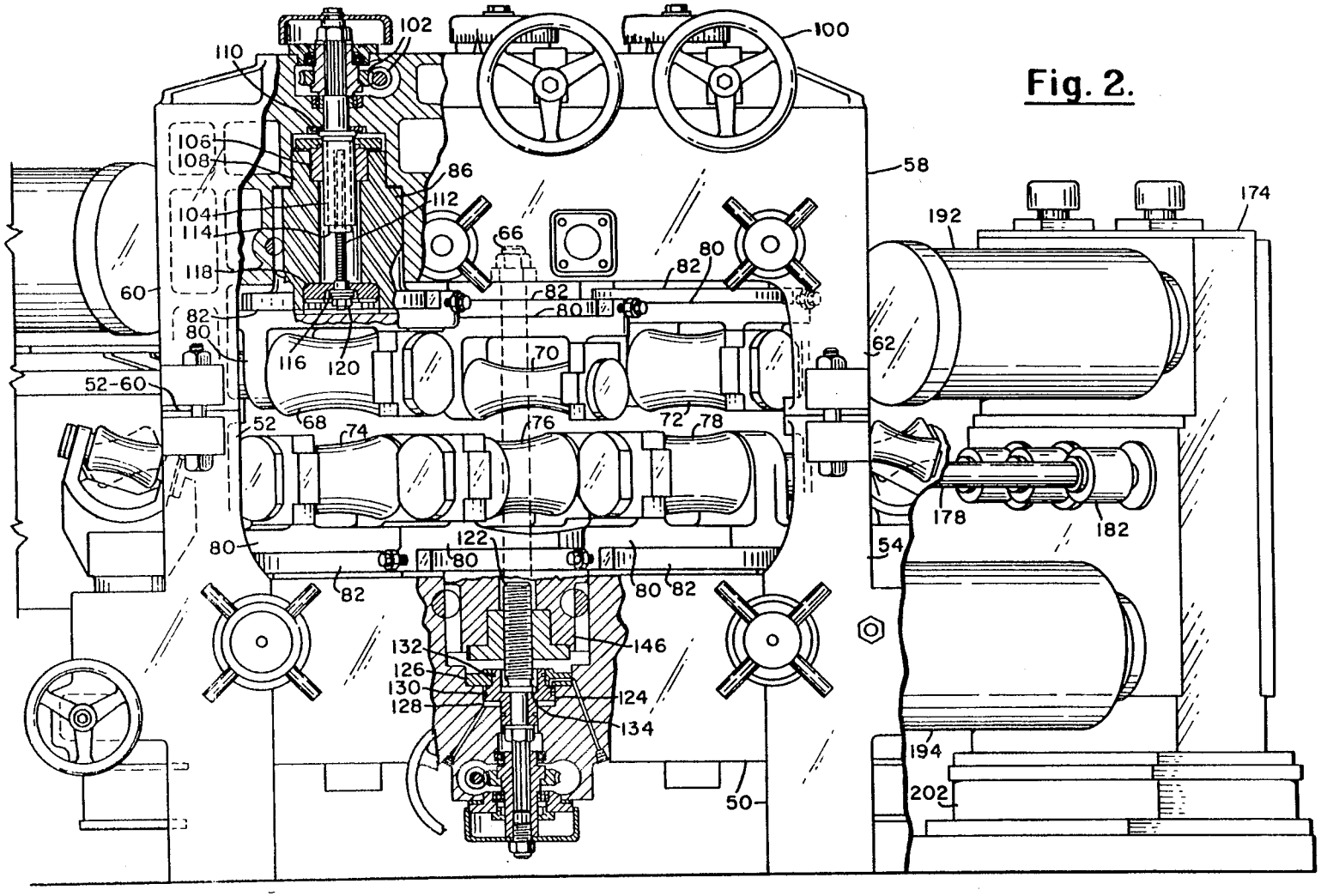
FIG. 2 is an elevational view of the apparatus of FIG. 1, portions of which have been removed to better disclose the details of the invention.
Figure 5:
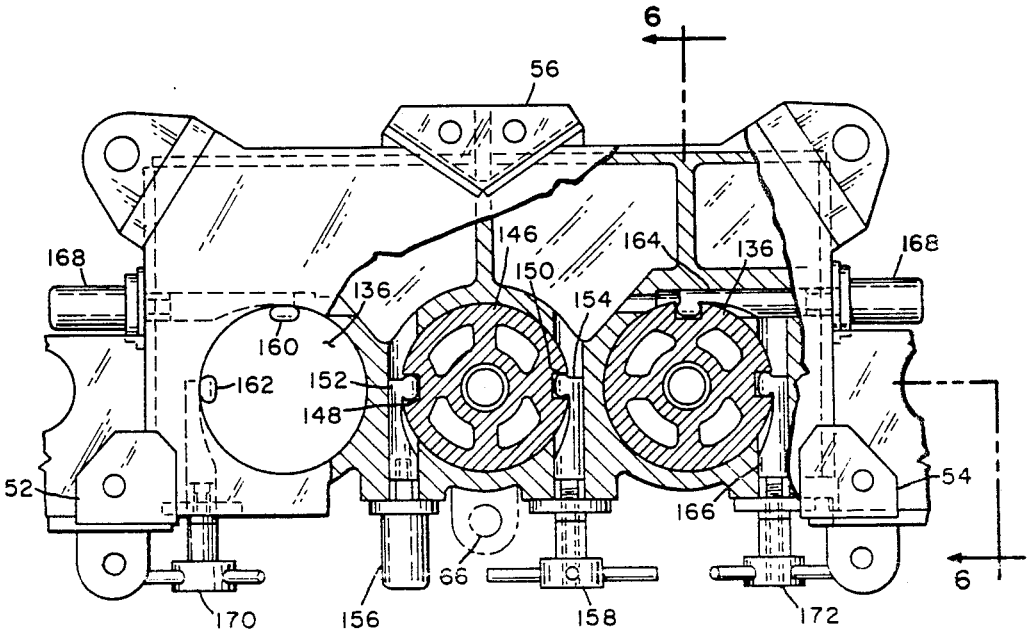
FIGS. 5 and 6 show the roll angling mechanisms and support for the lower end rolls. In addition.

As shown in hidden lines in FIGS. 2 and 5, a central removable tie rod 66, can also be included to reduce deflection in the main frame where especially severe separating forces and vibrations are anticipated, such as when straightening bars and heavy wall tubing of high strength materials. The presently disclosed main frame is more economical to assemble, and more precise and substantially stronger than conventional straightener frames, yet it facilitates rapid roll changes.

The cross-roll straightener of the preferred embodiment further includes upper work rolls 68, 70 and 72 and lower work rolls 74, 76 and 78 which are arranged in pairs 68-74, 70-76, and 72-78. The opposed rolls of each roll pair are skewed or oppositely inclined with respect to the pass line. The angular inclination of the axes of rolls 68 and 74 are the same as rolls 72 and 78 respectively. During the straightening operation, roll pairs 68-74, 70-76 and 72-78 are separated by a distance equivalent to the diameter of the stock or slightly less, and have angular contact with opposite sides of the stock so as to advance it in rotary motion while flexing it in a curved roll-pass formed by the offset central roll pair 70-76.

Work rolls 68-78 are mounted in brackets 80, which are fastened to plates 82 by bolts 84. Plates 82 are integrally connected to yokes 86, 136, or 146. Brackets 80 are constructed so as to support the roll neck bearings in inverse symmetry about each roll's longitudinal axis. The straightening loads have a tendency to turn each bracket 80 in a counterclockwise direction about its respective centerline 88. Therefore, roll bracket 80 supports the roll neck bearings laterally at portion 90 as well as vertically in the area where the main straightening load is transferred to plate 82 of yoke 86. The supporting portion 90 of bracket 80 is thus arranged to allow room for larger bearings and roll necks at adjacent ends 92 of the roll brackets as compared to conventional roll brackets on equivalent centers.

Figure 7:
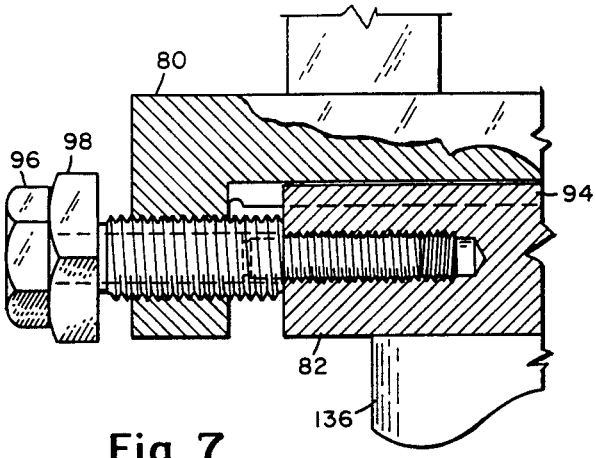
FIG. 7 is a sectional view taken along line 7—7 of FIG. 1 showing an adjustment mechanism for moving the roll bracket and roll axially.

As more specifically shown in FIG. 7, a mechanism is also provided for axially adjusting the roll to compensate for uneven roll wear or inaccurate machining. Through this mechanism, the roll is adjusted to the center line of its support as well as the center line of its opposed roll and the pass line. A key 94 guides bracket 80 such that the roll moves along its axis when adjusted. The rolls are adjusted by loosening screw 96 and turning hollow screw 98, until the proper longitudinal position of bracket 80 has been reached, after which screw 96 is again tightened. In addition, screw 98 which is threaded in the lug of bracket 80, can be extended to provide room for a locknut (not shown).

In addition to the angular adjustment of the rolls and their brackets, the upper rolls 68, 70 and 72 and their brackets 80 are vertically adjustable to accommodate stock of various diameters. Furthermore, the central roll pair 70-76 is vertically adjustable to deflect the stock to stress the outer portions of the stock beyond the yield point of the material over a distance equivalent to one pitch of the stock's surface motion as hereinafter further explained and illustrated in FIGS. 8–10. Specifically, handwheel 100 operates through a worm and gear reducer 102 to control adjusting screw 104. Adjusting screw 104 engages screw box 106 which is secured to stem 108, thereby moving yoke 86 with its attached plate 82 and roll bracket 80 and roll 68 up or down, as desired. Adjusting screw 104 is clamped to main top plate 58 at shoulder 110 but is free to turn. Play between threads of screw 104 in screw box 106 is prevented by a smaller diameter screw such as ball screw 112 which is threaded in a small diameter screw box 114 that is fixed in screw 104 and has the same thread pitch. Nut 120 is locked onto the smaller threaded portion at the end of screw 112 which is prevented from turning with respect to retainer 118. Ball screw 112 is preloaded by spring washers 116 of sufficient strength to urge retainer 118, yoke 86 and screw box 106 toward the lower side of the threads in screw 104. This arrangement prevents roll 68 from sagging when unloaded.

Lower rolls 74, 76 and 78 are provided with hydraulic overload devices to prevent damage to the rolls, bearings, or other parts by yielding when the applied load exceeds an adjustable maximum limit such as caused by outof-round or oversize stock. The overload devices are hydraulically interconnected and provided with a master control valve for fast simultaneous release of all the lower rolls. The lower adjusting screw 122 for the bending roll 76 and its bracket 80 are supported by a hollow piston 124 that is maintained in normal position by fixed retainer 126 and an extension or hollow rod are sealed at seals 130 and 132. Hollow piston 124 supports adjusting screw 122 at surface 134 which will yield together with piston 124 when applied roll pressure at roll 76 exceeds a predetermined maximum limit. An adjustable pressure regulator and gauge (not shown) are set to establish a maximum pressure limit at cavity 128 to enable the operator to control the load at which the respective roll yields. Other details of the lower, central screwdown are similar to those for the upper screwdown previously described.

Figure 6:
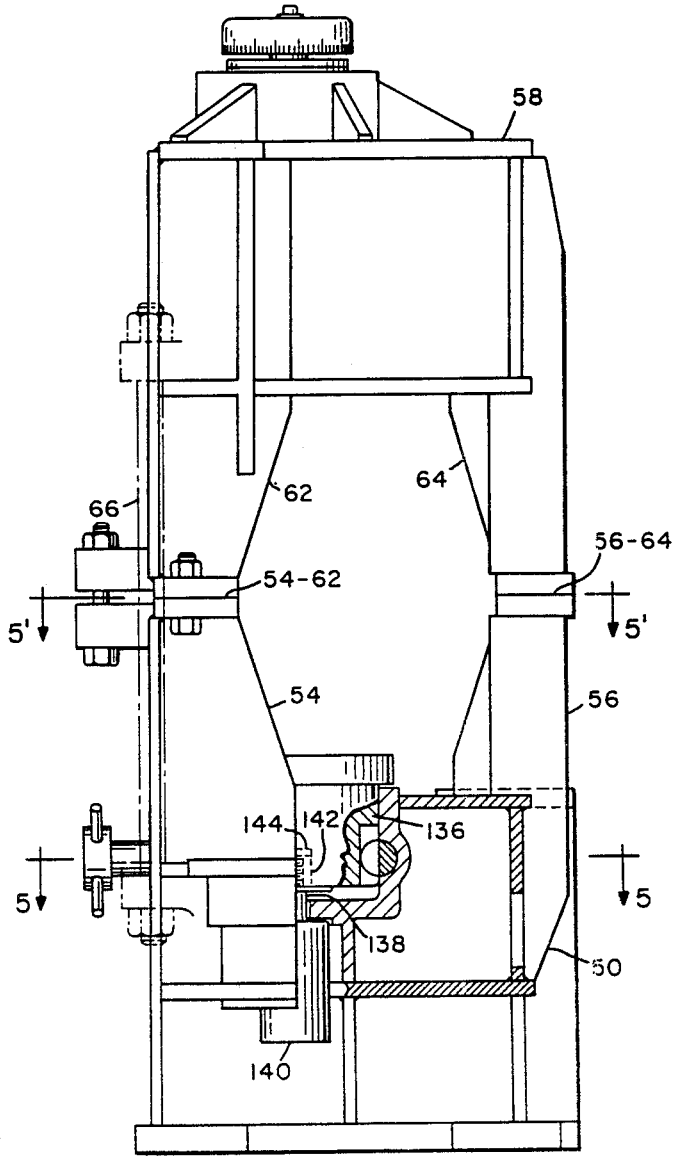

The roll yokes for the lower end rolls 74 and 78 are supported by relatively simple, inexpensive hydraulic cylinders. As shown in FIGS. 2, 5 and 6, rolls 74 and 78 and their roll brackets 80 and yokes 136 are supported by rods 138 of cylinder 140 mounted on main base 50. The rod ends are threaded in holders 142 that are provided with thrust bearings 144 on which yokes 136 are free to turn. In FIG. 6 the rods 138 are shown at the upper ends of their stroke in cylinder 140, from which they will yield when the roll loads on rolls 74 or 78 exceed the pressure for which the cylinders 140 have been set. The lower end-roll yokes may be set to yield at less load than the central bending roll, since they yield only when oversize stock is fed into the straightener and receive much less load from the straightening operation.

Alternatively, a separate automatically controlled, rapid hydraulic release of the roll pressure similar to that described for the central roll 76 can also be used for the upper roll 68 or lower roll 74 the entering roll pair 68-74. This will allow the stock to be entered sideways between the rolls of roll pair 68-74 when the upper roll is retracted, thus facilitating quick startup of the straightening operation. In such a case the extensions 52 and 60 must be relocated. If an upper roll screwdown is furnished with the rapid release mechanism described for the central, lower adjusting screw, the screw preload mechanism, including screw 112, can be maintained.

The mechanisms for angling the yokes that support the end rolls and the middle rolls are substantially similar. Central yoke 146 shown in Figures 2 and 5 has two keyways 148 and 150 with which rounded key portions of spindles 152 and 154 slidingly engage. to decrease the roll angle of roll 76, cylinder 156 is activated to turn yoke 146 in a clockwise direction. When roll 76 is in the selected angular position, cylinder 156 is stopped and the piston is locked by tightening nut and handwheel 158 and pressure in cylinder 156 is reversed. To turn adjusting screw 122, pressure in cylinder 156 is temporarily released. In smaller machines, cylinder 156 can be substituted by another nut and handwheel similar to 158. Similarly, the end roll yokes 136 each have two keyways with which rounded key portions 160 and 162 of spindles 164 and 166 slidingly engage, cylinders 168 are activated to turn yokes 136 in the direction desired. When rolls 74 and 78 are in the selected angular position, cylinder 168 is stopped and the piston is locked by tightening nut and handwheels 170 and 172 and the pressure in the cylinder 168 is opened to the piston side. Spindles such as 152, 154, 164 and 166 are prevented from turning by keys and keyways (not shown). The threaded portions of the spindles having threaded handwheels, such as 158, 170 an 172, may be extended through the handwheels and provided with locknuts, beyond the handwheels (not shown) in order to secure their adjusted positions when the pressure in angling cylinders 156 and 168 is temporarily released for screwdown adjustments, for overload yield of the lower roll or for rapid release of the lower rolls. In such cases the relief of the pressure in the angling cylinders 156 and 168 should be automatic. For example, it could be activated by the movement of a lower roll and its support, as well as other methods and sensing devices known in the art.

The angling mechanisms for the upper roll supports are similar to those shown for the lower roll supports. The previously described preloading mechanism for the upper screwdowns advantageously prevents sag in the roll supports during the angling adjustment as well as when the screwdowns are operated.

The central adjusting screw 122 and the angular adjustment of the central lower roll 76 is operable regardless of the hydraulic pressure under supporting piston 124. The angular adjustment of the lower end-rolls 74 and 78 and their yokes 136 is only slightly affected by the weight on their supporting cylinder rods 138 and the friction in the thrust bearing 144 supporting the roll yokes 136 on the rod ends.

In the preferred embodiment, the 6-roll straightener of the invention has two central rolls of generally unequal diameter while the end roll pairs have substantially the same diameters. Female roll 70 of the central roll pair is of generally smaller diameter than bending roll 76. Concave rolls 68 and 72 are on the same side of the stock as female roll 70, but of generally larger diameter than female roll 70. Rolls 68 and 72 are opposed by concave rolls 74 and 78 that are generally the same size and shape as rolls 68 and 72. Guide rolls 206–208 and 210 produce reverse flexures in the stock so that, considering the flexed portion $L_1$ of the stock by itself, the major reacting shear forces Q occur outside of the central curved pass and act at the points of contraflexure "P.C.", in the sense and direction shown dotted in FIG. 9.

Roll pairs 70-76, 68-74 and 72-78 are driven by gear drives 174 and 176 that are connected to spindles 178 that drive rolls 74, 76 and 78 and spindles 180 that drive rolls 68, 70 and 72. Spindles 178 and 180 are of uneven lengths. Spindles 180 and gear drive 176 are connected to upper rolls 68, 70 and 72 through universal joints 184 and spindles 178 and gear drive [means] 174 are connected to lower rolls 74, 76 and 78 through universal joints 182. The drive further includes a first common gearbox for spindles 178 and a second common gearbox for spindles 180. Preferably, each gear drive is connected to three motors for individually driving spindles 178 and 180 with two of the motors located above the spindles and one below.

Preferably foot mounted motors are used with two motors mounted to upper plate 186 (shown in phantom) and the lower mounted to lower plate 188, the motor shafts are connected to the pinion shafts by means of flexible couplings (not shown). The motors are all shown flange mounted in FIG. 4. In high speed applications, it may also be preferable that the spindles are of equivalent lengths between the respective universal joints 182 and 184. In such cases, the splined shafts that rest in the hollow splined output shafts of the gear drive can be extended and mounted in a floating bearing mounted on plate 186 for support.

Figure 4:
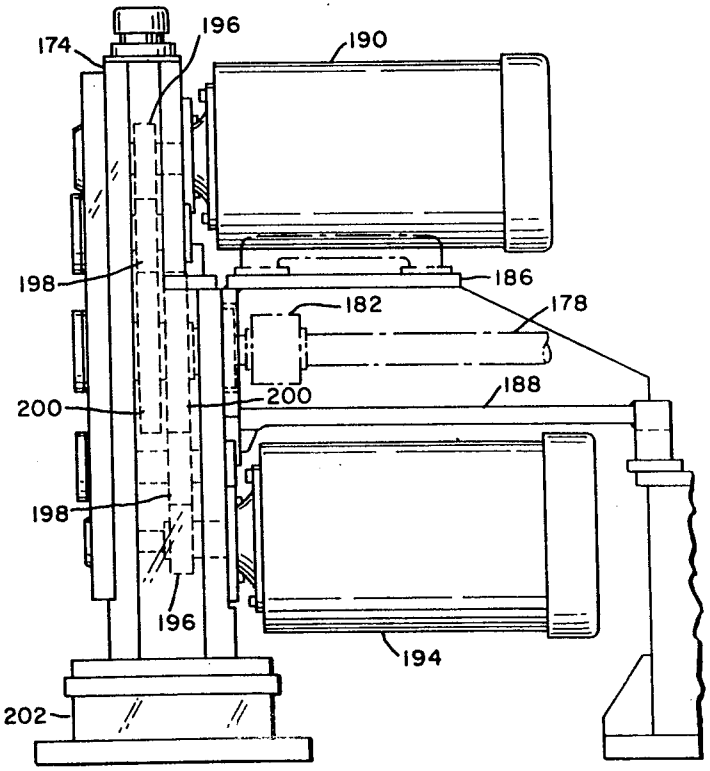
FIGS. 3 and 4 show the bottom roll drive in FIG. 1 with the drive spindles removed in FIG. 3 and shown in phantom in FIG. 4.
Figure 3:
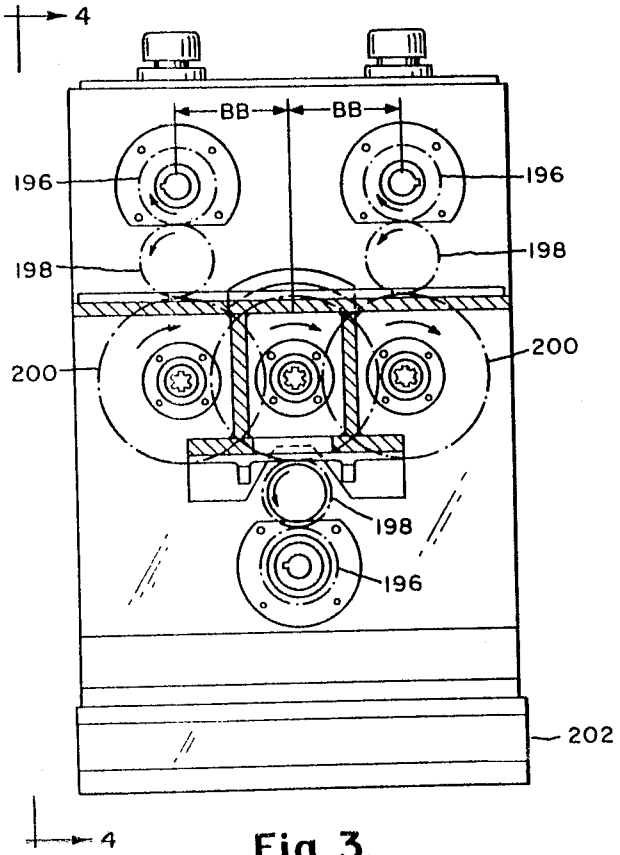

Gear drive 174 is shown more particularly in FIGS. 3 and 4 wherein two upper motors 190 and 192 and one lower motor 194 drive pinions 196 and intermediate gears 198. Gears 198 in turn drive the output gears 200 mounted on hollow splined shafts, which drive spindles 178 by means of universal joints 182. Preferably gears 196, 198 and 200 are all straight spur or helical gears mounted on parallel shafts, to provide an efficient and economical arrangement. According to the disclosed arrangement, the distances BB—BB in FIG. 3 can be increased in order to accommodate larger frame motors without increasing the distance between spindles 178. Mounting motors 190, 192 and 194 on the same side as the drive spindles advantageously provide a more compact arrangement. Preferably motors 190, 192 and 194 are mounted on gear drive 174 or its bracket extension 186 or 188 and then, in field assembly, the drive means with its motors is mounted on bed plate 202 and main base 50.

Top roll gear drive 176 is substantially the same as bottom roll gear drive 174 except that the gear reduction for driving the smaller top roll 70 is lower in order to develop substantially the same circumferential speed for roll 70 as for the other working rolls.

Figures 8, 9, 10:
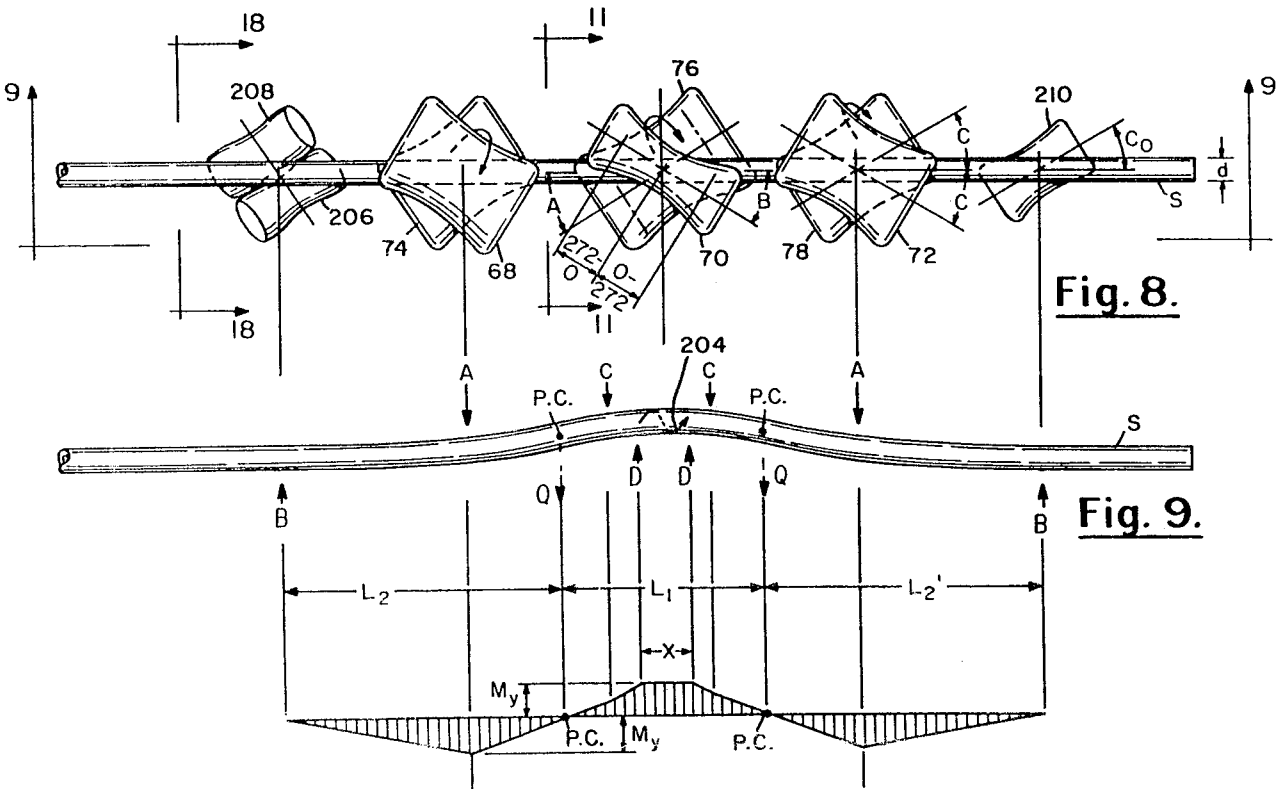
FIG. 8 is a schematic of the roll arrangement of the subject invention wherein a pair of guide rolls at the entry end guide and support the stock into the first pass of the main working rolls, and a single guide roll and horizontal guide support the stock at the outlet end.
FIG. 9 illustrates how the stock if flexed in FIG. 8.
FIG. 10 is a moment diagram for the stock of FIGS. 8 and 9.

The operation of the present invention is generally illustrated in FIGS. 8, 9 and 10. As shown in FIG. 8, roll pairs 70-76, 68-74 and 72-78 are inclined with respect to a longitudinal axis by roll angles A, B and C. The stock S is shown as moving in the direction of arrow 204 as it is rotated such that any point on the surface of stock S will move in the pattern of a left hand helix. Roll pairs 68-74 and 72-78 have straight pass contours while roll pair 70-76 forms a curved pass for the stock. Roll 76 is the male roll and is located on the convex side of the central curved pass. Roll 70 forms the concave side of the central curved pass. Roll angles A and B of the central rolls 70 and 76 are adjusted for flexure and size and roll angle C of the end rolls 68, 72, 74 and 78 are varied or adjusted to suit the various sizes of stock. The end roll pairs 68-74 and 72-78 and central roll 70 are adjusted lower roll-angles B and C for smaller sizes of stock S. Because roll 76 is on the convex side of the curved pass, generally smaller changes in roll angle A are required to accommodate variations in stock sizes than are required for roll 70. In order to maintain a substantially constant speed ratio between rolls 70 and 76 for the outside and inside curvatures of the stock as it moves forward in rotary motion, it is important that variations in the roll angle B of roll 70 to accommodate changes in stock sizes be small in relation to roll angle A. Roll angle B is thereby kept substantially equal to roll angles A and C for the full range of sizes and materials for which the straightener is intended to be used.

As illustrated in FIGS. 8, 9, 10 and 11, the central roll pair 70-76 of the present invention is designed to flex the stock to a desired minimum radius of curvature over a distance x equivalent to at least one pitch of the helical travel of the stock surface. The central roll pair thereby flexes all portions of the stock to a substantially uniform radius of curvature in all directions for improved straightening by flexure. This flexure results in approximate loads B, A, C and D as illustrated in FIG. 9. In addition, as illustrated in FIG. 10, substantially constant moment MY is provided over distance x.

Figure 11:
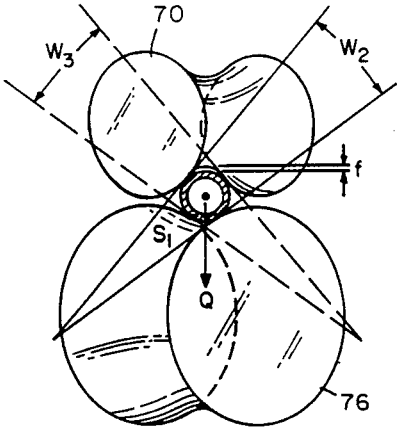
FIG. 11 illustrates the wedge angles at the entry and exit ends of the central roll pair, where the female roll is of generally smaller diameter than the opposed, male roll.

Since the average diameter of roll 70 is smaller than the average diameter of roll 76, particularly the diameters at the roll ends the preferred embodiment provides substantial support in the wedge angles as well as close guidance of the stock. As shown in FIG. 11, an appropriate ratio between the opposed rolls 70 and 76 is selected with respect to the stock's flexure to form stock contact angles $W_2$ and $W_3$ at the respective ends of the central pass. The rolls thus support the stock within angles $W_2$ and $W_3$ at the ends of the intermediate roll pair to provide support throughout the curved pass. As illustrated by Shear Q, FIG. 11 further shows how the flexure of the stock S forces it into the angles $W_2$ and $W_3$ at both ends of the central curved pass. FIG. 11 is taken along line 11—11 at the entry end of the central roll pair, but would be the same if taken in the opposite direction at the outlet end of the central roll pair. This is completely contrary to the roll diameter proportions as shown in the prior art where the bending roll is smaller than the female roll and where the main bending forces are contained within the curved pass.

Figure 15:
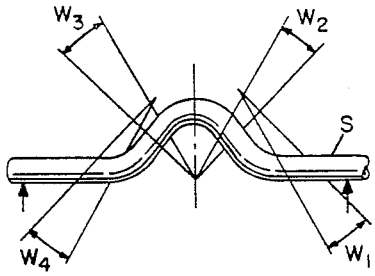
FIG. 15 is an illustration showing how the roll wedge-angles adjacent the central and end roll passes guide the stock during its forward travel in rotary motion.

An alternative embodiment of the cross-roll straightener of the subject invention is illustrated in FIGS. 12–15 wherein stock "S" is shown in exaggerated flexure. The embodiment illustrated in FIG. 12 has a central curved pass that is formed by the male bending roll 76 and female roll 70 of generally smaller diameter opposed thereto. For the alternative roll arrangement of FIGS. 12–15, rolls 74 and 78 are of generally smaller diameter than rolls 68 and 72 and are offset from rolls 68 and 72 by an adjustable distance "e" along the longitudinal axis of the machine and outwardly from the center thereof. This adjustment is not required for the embodiment of FIGS. 1–8. As shown in FIG. 15, the adjustable offset "e" of rolls 74 and 78 restrains the stock in the end passes by forming wedge angles $W_1$ and $W_4$ adjacent the inside ends of roll pairs 68-74 and 72-78. Wedge angles $W_1$ and $W_4$ complement the wedge angles $W_2$ and $W_3$ adjacent to the ends of the central pass. The magnitude of offset "e" is thus selected to substantially reduce lateral movement of the stock adjacent the inside ends of roll pairs 68-74 and 72-78; to improve reverse flexure of the stock; and the entry and delivery of the stock.

In some cases, particularly where the female roll is small in diameter with respect to the male roll, the diameter of the female roll at the contour end can be very large in proportion to the diameter of the female roll at the tranverse axis.

Figure 12:
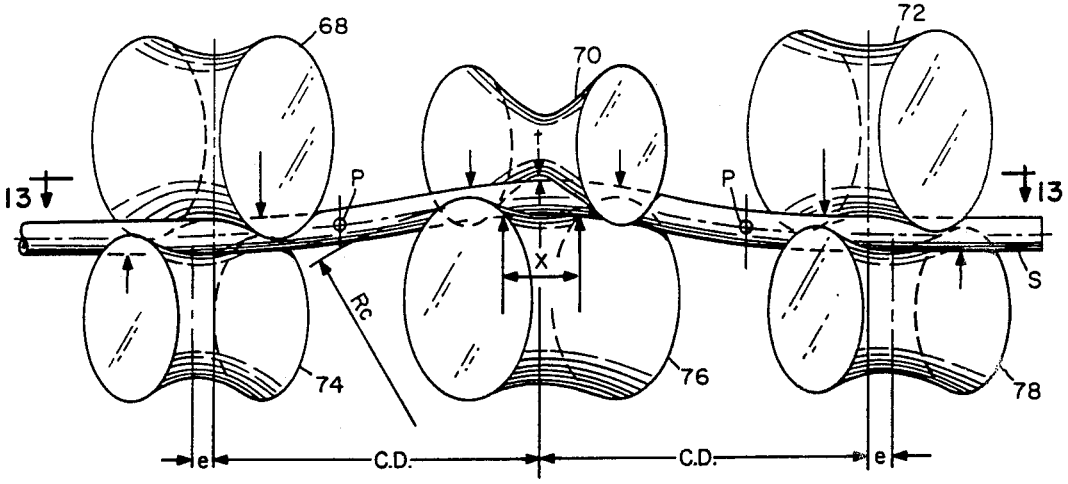
FIGS. 12 and 13 show an alternative embodiment of the roll arrangement of the subject invention wherein the bottom end rolls are of generally smaller diameter than the opposed top end rolls and are offset outwardly with respect thereto.
Figure 13:
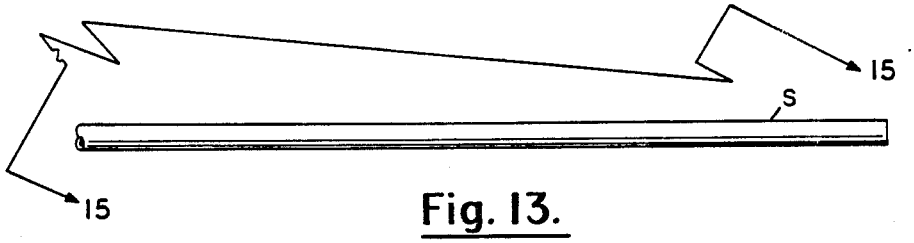
Figure 14:
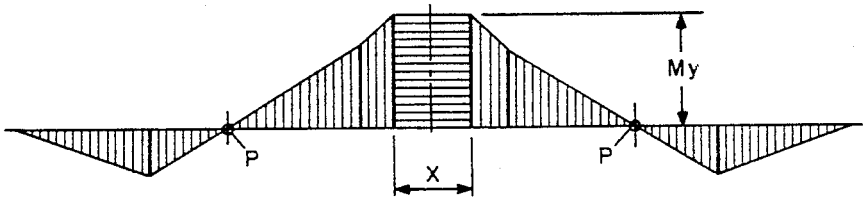
FIG. 14 is a moment diagram of the stock as flexed in FIG. 12 beyond the yield point of the material to a constant radius of curvature over distance "x".

In such cases, it may be preferable when straightening large size stock that the stock does not touch the central portion of the contour of female roll 70 to avoid excessive "slippage" between the stock and the female roll through the central contour. Thus, the compound contour of the female roll will allow for a gap "t" as shown in FIG. 12 to be maintained between the stock and the female roll 70. On the other hand, by increasing all roll angles slightly and applying roll pressure on the stock at the tranverse axis of the central roll pair, the female roll ends will not touch the stock, while the central "cold work" will augment the flexural stresses for more efficient straightening, particulary when the stock is tubing.

Still another 6-roll arrangement may seem better for straightening end hooks. Such an arrangement will have a central straight pass roll pair wherein the smaller diameter roll and a portion of the larger diameter roll are adjusted above the roll pass of the entering and leaving end roll pairs. Compare FIGS. 8, 9 and 12. The stock's leading end will enter the central pass without difficulty and be guided by the wedge angle at the entering end of the central pass. Almost any amount of flexures may be obtained between the roll pairs. Only peak moments are obtainable, however, and a near constant moment over distance "X", shown in FIGS. 10 and 14, as required for good straightening, is unobtainable.

Another 6-roll arrangement having a central curved pass roll pair of uneven diameter rolls, where the female roll is the larger diameter roll, will require speed control of the central rolls in order to enter the leading end of the stock into the central pass, if the central curved pass is to augment the main flexure between the end roll pairs.

Still another roll arrangment, similar to the 6-roll arrangement of FIG. 8 should be mentioned. In this arrangement the end roll pairs are substituted by 3-roll clusters and the axis of the small diameter female roll is parallel to the axis of one roll in each 3-roll end cluster. By having such a roll arrangement it is possible to dirve the three rolls in a cluster roll straightener with 50% more driving power than for a conventional 7-roll straighteners. In addition, the central female roll will guide the stock into the wedge angle at the entry end of the central pass and start the opposed male idler roll rotating by frictional engagement between the stock and the two rolls. Such an additional female roll with greatly increase the capacity of the machine to straighten the smaller diameter, high yield strength tubes. It will also straighten upset end tubing better, since the female roll may be temporarily withdrawn, automatically, as the upset end activates a sensing device near the entry end of the central roll pair, which actuates the hollow piston and withdraws the roll and its support, as already described for the central lower roll 76 in FIG. 2.

Twin Guide Rolls

Figure 1:
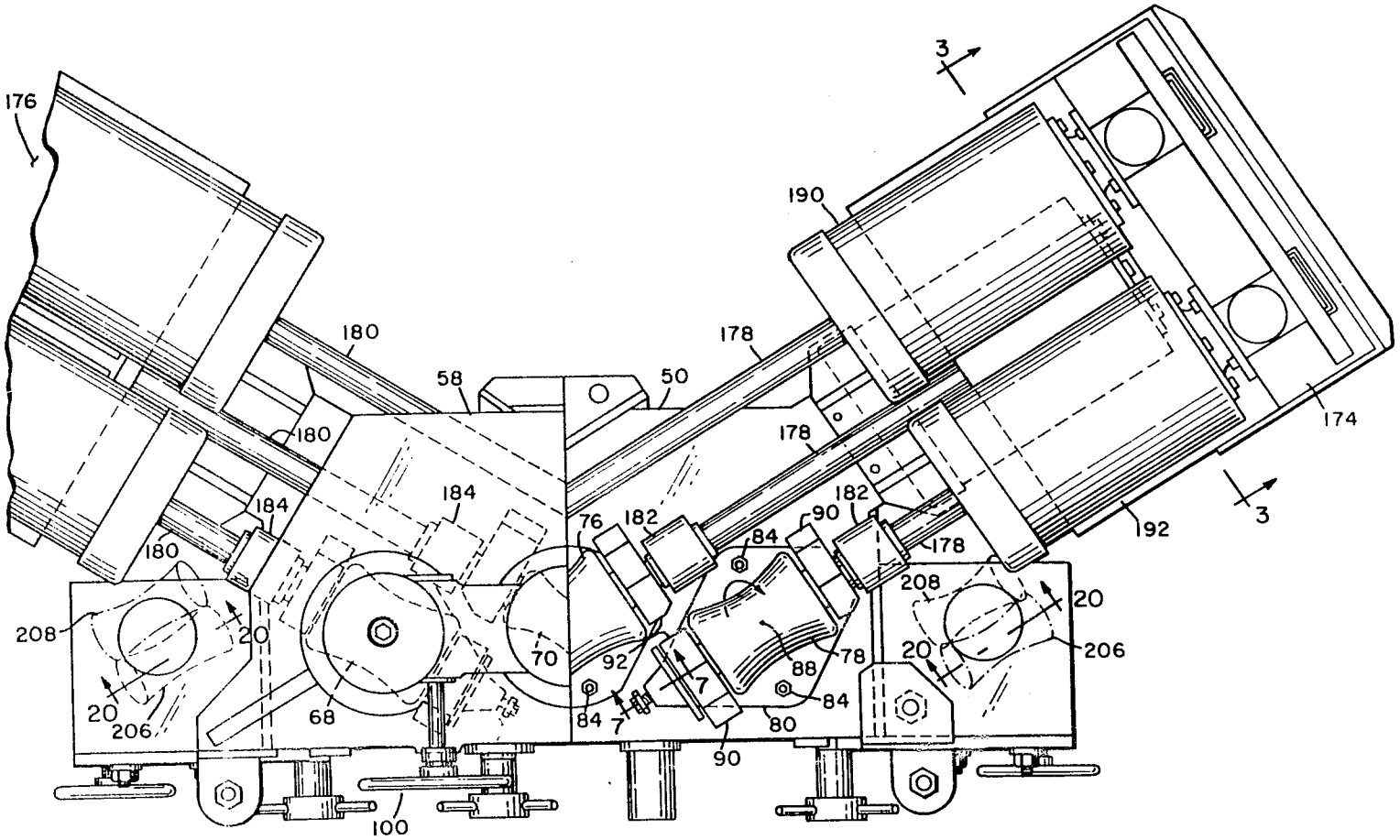
FIG. 1 is a plan view of a presently preferred embodiment of the subject invention in partial section, showing some of the bottom work rolls with their respective drive and showing, in phantom, some of the top work rolls and their drive.
Figure 17:
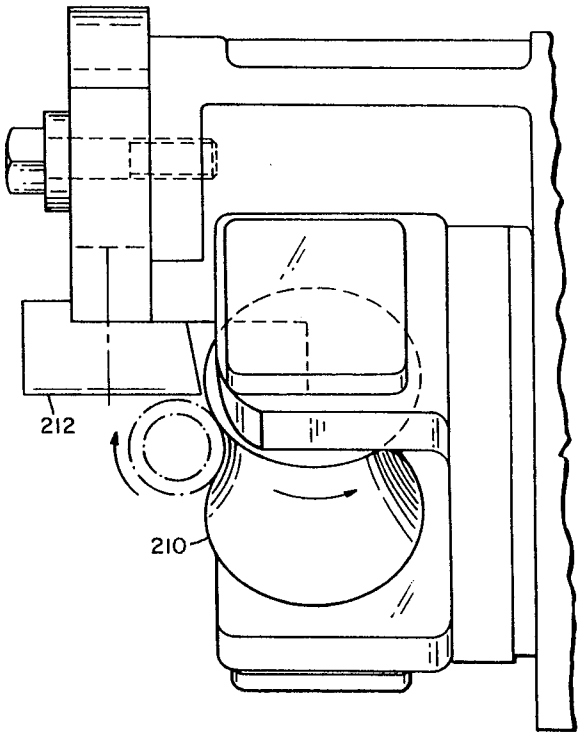
FIGS. 16 and 17 show an alternative guide and guide roll for use at the outlet or inlet end of the main working rolls.
Figure 16:
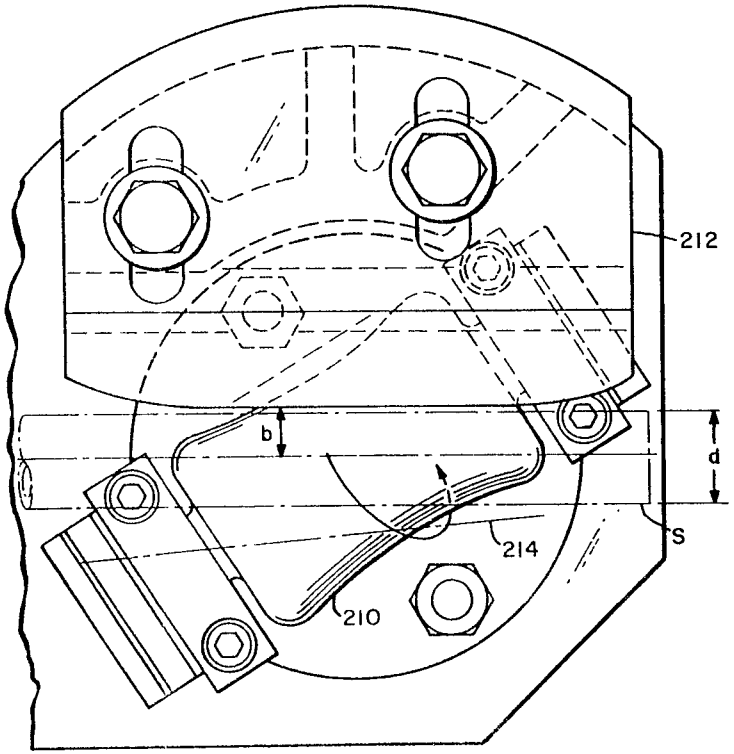

In addition to the work roll pairs 70-76, 68-74 and 72-78, the subject invention can further include guide rolls at the inlet and outlet ends of the straightener. FIGS. 1 and 2 show a preferred embodiment having twin guide rolls 206 and 208 at the entering and exit ends of the 6-roll straightener. FIG. 8 illustrates the use of twin guide rolls 206 and 209 at the entering end in combination with a single guide roll 210 with a guide 212 at the exit end of the straightener. Single guide roll 210 and guide 212 are shown in detail in FIGS. 16 and 17. Twin guide rolls 206 and 208 and guide roll 210 may form oversized straight or curved passes, while guide 212 forms the side of a straight or tapered pass. Guide rolls 206 and 208 are further provided with a vertical adjustment similar to that of roll 76 as may single guide roll 210. Used in combination with two horizontal guides 212 and 214, single guide roll 210 can be substituted for guide rolls 206 and 208 at the entering end of the 6-roll straightener. Such a combination is less expensive than twin guide rolls 206 and 208.

As shown in FIGS. 1, 2 and 8, guide rolls 206, 208 and 210 are not driven but act as cradles to position the stock at the entering and exit ends of the straightener and to maintain the ends of the stock in the pass line. These guide rolls provide supports that flex the stock into reverse flexures, to better straighten reverse bends and end hooks in the stock. The guide rolls also reduce whipping of the stock caused by the crookedness thereof to allow higher operating speeds for the straightener.

Preferably, the guide rolls are provided with flexible, shock absorbing supports that absorb the impact of the whipping action of the stock as it is rotatingly advanced through the straightener. If the guide rolls 206–208 and 210 are not touching the stock, the latter will assume a single flexure between roll pairs 68-74 and 72-78, similar to a simple beam on two supports A—A. See FIGS. 8 and 9. Such a single flexure and moment diagram will produce the relatively smallest straightening loads A—A and C—C caused by the approximate roll loads D—D and is sufficient to straighten the larger stock sizes. For smaller stock sizes, however, more abrupt flexures are required and by adjusting the outboard guide rolls 206–208 and 210, vertically, so as to produce sufficient forces B that will subject the stock to reverse flexures; the single flexure will be reduced in length from the distance between the roll pairs 68-74 and 72-78 to the distance L, between the points of contraflexure P.C. as shown in FIGS. 9 and 10. In the latter case the straightening loads will be relatively larger, but for the small stock sizes the loads can still be held lower than those required to straighten the largest stock size in a single flexure. The curved pass of the central roll pair 70-76, together with the reverse flexures of the disclosed straightener provided improved means to straighten various stock sizes and materials over conventional multi-roll straighteners.

Figure 19:
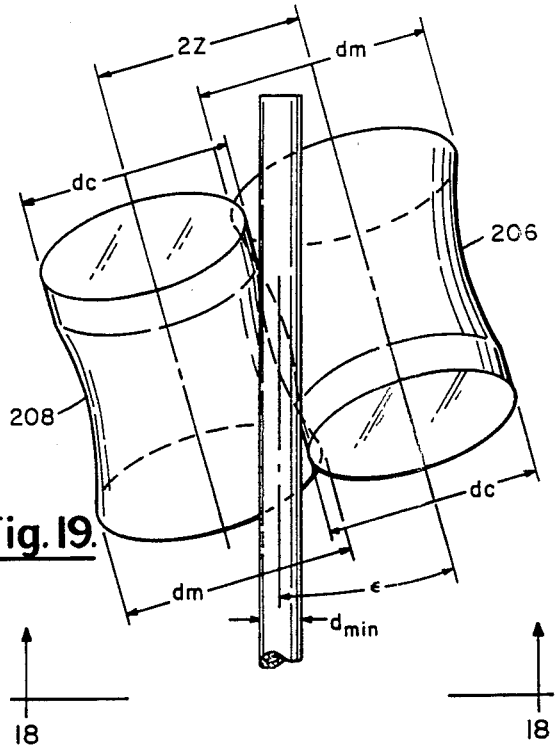
FIGS. 18 and 19 show the guide roll pair of FIG. 8 supporting one stock size.
Figure 18:
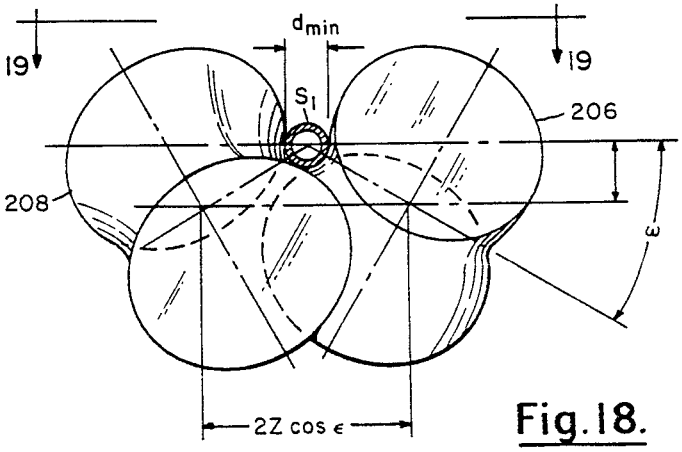

For high speed, precision straightening, twin guide rolls 206 and 208 are preferably used both at the inlet and outlet ends of the straightener, as shown in FIGS. 1 and 2. The horizontal angling and vertical adjustment of the twin rolls is similar to that previously described for the lower, central adjusting screw as shown in FIGS. 2 and 5. As further shown in FIGS. 19 and 20, the angle $\epsilon$ determines the direction of the pass line of the twin rolls, while angles $\gamma_1$ and $\gamma_2$ determine the stock diameter. Twin rolls 206-208 of FIG. 8 position and guide the stock by contacting the average stock size of diameter d on the lower side of the stock at the same angle $C_0$ as the straight pass roll-angle C.

Figure 20:
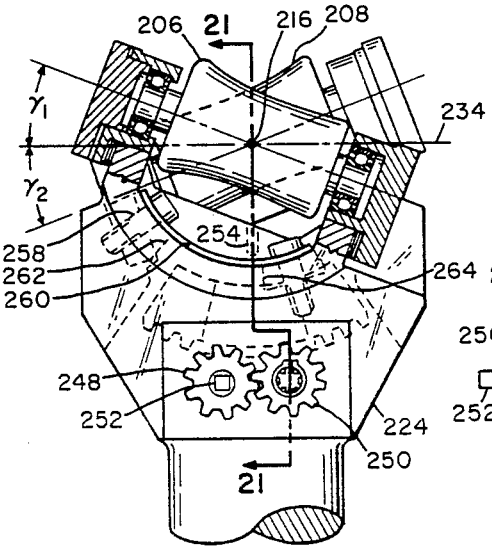
FIGS. 20 and 21 are sectional views showing the guide rolls of FIG. 1.
Figure 21:
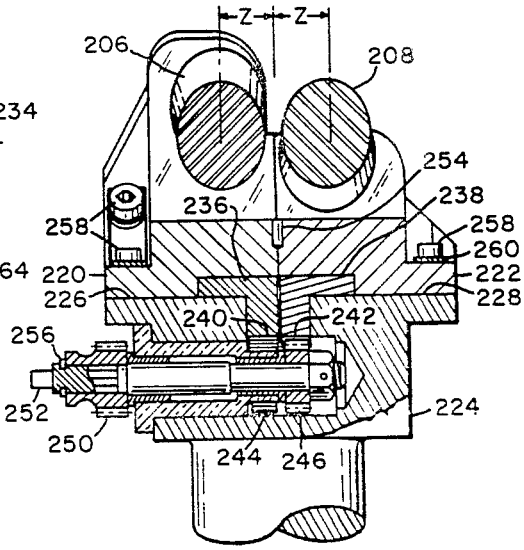

As shown in FIGS. 20 and 21, rolls 206-208 are located side by side, but oppositely tilted by equal angles $\gamma_1$ and $\gamma_2$ with respect to a horizontal plane through a common roll transverse axis 216 parallel to the stock axis. Rollers 206 and 208 are positioned on the common transverse axis with a constant distance 2Z between their longitudinal axes and at a variable angle $\epsilon$ to the stock axis. The relative angular location of rollers 206 and 208 varies for various stock sizes d. For example, angle $\epsilon$ must be increased and angles $\gamma_1$ and $\gamma_2$ decreased for fulll contact with larger stock sizes. Thus the angles $\gamma_1$ and $\gamma_2$ are adjusted according to the stock size and $\epsilon$ is then adjusted according to the direction of the stock axis until it coincides with the axis of the straight roll passes between roll pairs 68-74 and 72-78. Both of these conditions are met by the adjustment mechanism shown in FIGS. 20 and 21.

As shown in FIGS. 20 and 21, twin guide rolls 206 and 208 are mounted in tiltable roller brackets 220 and 222 in one stem and support 224, which is adjustable in a vertical direction and can be turned about its vertical axis for different stock sizes. Stem and support 224 has cylindrical segments 226 and 228, in which roller brackets 220 and 222 are supported. Angles $\gamma_1$ and $\gamma_2$ are the angles of the roller's longitudinal axes with respect to a plane 234 through centerline 216. Angular cross sections of segments 236 and 238 have gear teeth 240 and 242 that are separately engaged by pinions 244 and 246. Similar size pinions 248 and 250 engage each other at the front, as shown. By turning square 252, pinions 248 and 250 will turn in opposite directions as will pinions 244 and 246 and angle segments 236 and 238. Segments 236 and 238 are fastened to brackets 220 and 222 which carry rolls 206 and 208. Vertical angles $\gamma_1$ and $\gamma_2$ decrease or increase depending on whether square 252 is turned clockwise or counterclockwise.

Centerline 216 is in a plane 234 that is parallel to the stock axis and is normally horizontal, except when the support for the stock is to be tilted. When angles $\gamma_1$ and $\gamma_2$ are to remain constant but plane 234 is to be horizontally tilted, a dowel key is inserted at keyway 254 and pinion 250 is removed after removing retaining ring 256. Cap screws 258 must be loosened before square 252 is turned and after adjutments have been completed, again tightened against the segment washer 260. Cap screws 258, in each segment move in the respective slots 262 and 264 in brackets 220 and 222. Brackets 220 and 222 are then fastened and locked in the respective segments 226 and 228 of stem and support 224.

Figure 23:
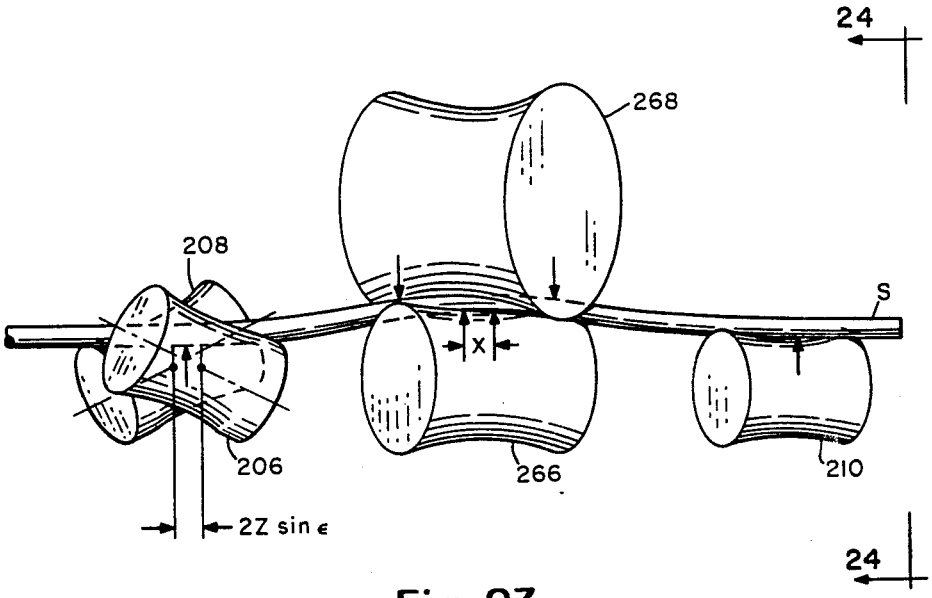
FIGS. 23 and 24 show a pair of working rolls of 2-roll straightener in which the male roll is of generally smaller diameter than the opposed female roll, with inlet and outlet guide rolls of the present invention.
Figure 24:
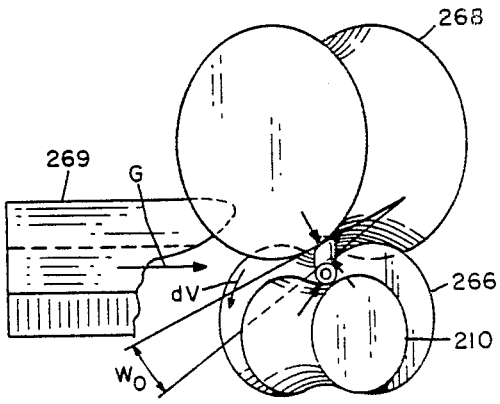

In an alternative embodiment, FIGS. 23 and 24 illustrate how twin guide rolls 206 and 208 and guide roll 210 can be used to position the stock at the ends of the curved pass of a single crossroll pair 266-268. The stock is wedged by the straightening loads into angles $W_0$ formed at the entering and exit ends of roll pair 266-268 to maintain it in the curved pass. Guide rolls 206, 208, and 210 tend to force the stock into the wedge angle $W_0$ at both the inlet and outlet ends.

In accordance with the present invention, the crossroll pair 266-268 of FIGS. 23 and 24 is preferably combined with inlet and outlet supporting guide rolls. Since the larger diameter roll 268 is the female roll and the smaller diameter roll 266 is the male roll, the stock will be wedged into angles at the ends of the rolls and thus maintained in the curved pass, provided the stock is engaged throughout the pass. Therefore, as the stock enters the pass but before it becomes fully engaged, the rotational speed of the smaller roll 266 is made such that its peripheral speed is slightly higher than that of the larger roll 268. Since the smaller diameter male roll has a higher peripheral speed than the larger diameter female roll, the stock tends to be forced into the wedge angle and is thereby maintained in the curved pass at the entry end. Conversely, the peripheral speed of the smaller roll may be made slightly lower than the peripheral speed of the larger roll as the trailing end of the stock leaves the outlet end of the curved pass so that the stock is forced into the wedge angle at the outlet end.

FIGS. 23 and 24 illustrate how the differential peripheral speed dV forces the stock into a wedge angle at the entry end of the roll pair. A full length guide 269 laterally supporting the stock as indicated by "G" will thus maintain the stock in the pass, particularly when the trailing end of the stock has passed the central portion of the curved roll pass. A drag is provided in the drive for the larger diameter roll such that the appropriate speed differential is maintained, but that will permit the rolls to turn at an equal peripheral speed when both rolls engage the stock. There are several alternatives for accomplishing this variation in the relative speed of rolls 266 and 268.

Figure 31:
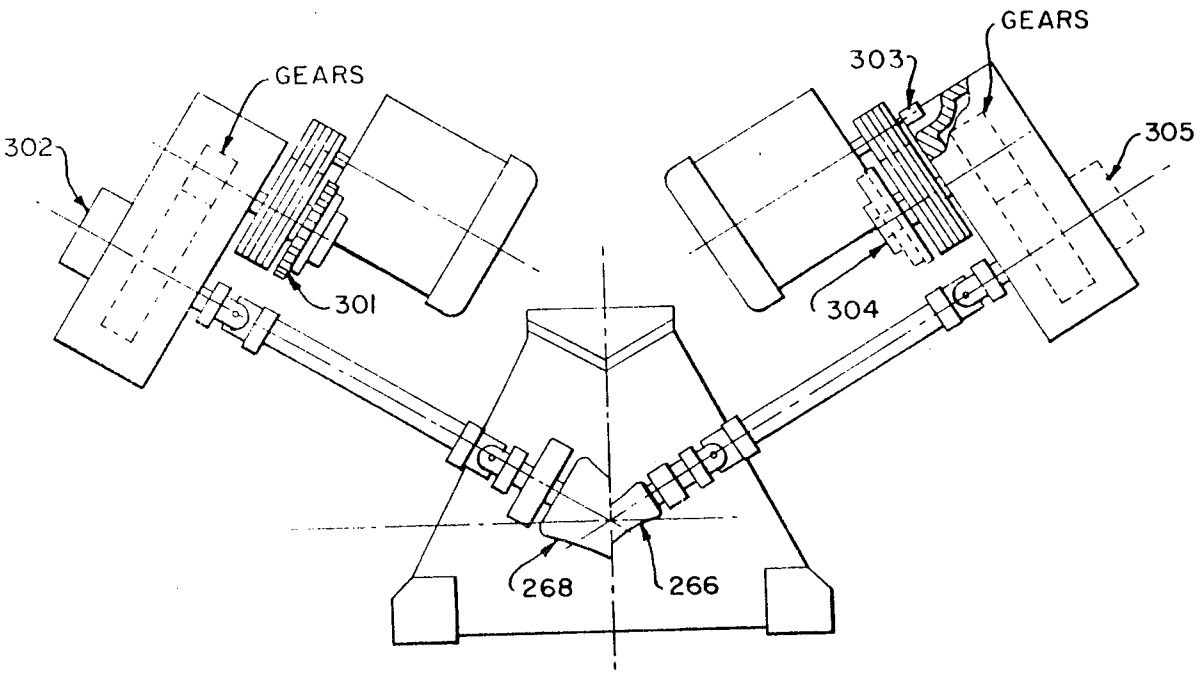
FIG. 31 shows a clutch and brake in the drive means for the large diameter roll.

In the first alternative as shown in FIG. 31, a clutch 301 is provided in the drive means for the larger diameter roll and an adjustable, light brake 302 in the drive means between said clutch and the larger diameter roll. The clutch may be a magnetic clutch which is automatically disengaged as the brake is engaged. The brake causes a slight drag on the larger diameter roll, in order that the stock may be forced laterally into the wedged support formed by the stock's contacts with both rolls at the entry end of the pass. The stock, supported on the pass line, will now be driven forward in rotary motion by the smaller diameter roll's higher peripheral velocity, while the female roll is driven by frictional engagement with the stock, until an adjustable sensing device—preferably a counter of revolutions 303—causes the brake to be disengaged and the clutch to be reengaged shortly after the leading end of the stock has traveled beyond the center of the pass.

Since both rolls normally are driven at substantially equal peripheral speeds, a sensing device mounted ahead of the roll pass entry end should be located and timed such that it will cause the clutch and brake to be disengaged and engaged, respectively, to cause the desired amount of drag on the larger diameter roll before the stock is entered into the pass. Such a timer should preferably be a counter of revolutions 303 and fractions thereof of the motor, becuase the stock throughput speed is almost proportional to the revolutions of the smaller diameter roll. The mentioned timer or other sensing device should further be timed such that the brake in the drive means for the larger diameter roll is disengaged and the clutch reengaged when the leading end of the stock has traveled beyond the center of the roll pass. The drive means for both rolls will now continue at normal speed until the stock is discharged at the exit end of the pass and another stock length is about to enter the machine. The sensing device causes the clutch in the drive means for the larger diameter roll to be disengaged and the brake engaged.

If it is considered important that the trailing end of the stock be held firmly in the outlet end wedged support of the roll pass, this may be accomplised by providing a clutch 304 and brake 305 in the drive means for the smaller diameter roll. Such a clutch and brake may be actuated by the trailing end of the stock. The sensor for the smaller diameter roll can be the same as for the larger diameter roll, or independent thereof. When the trailing end of the stock leaves the exit end of the pass another sensing device will automatically disengage the brake and reengage the clutch in the drive means for the smaller diameter roll, so that another stock length may be entered between the rolls at the entry end. Both of the mentioned brakes may be unnecessary if the inertia of the respective rolls are sufficient to cause enough drag on the respective rolls to force the stock into the respective wedge angle.

Figure 32:
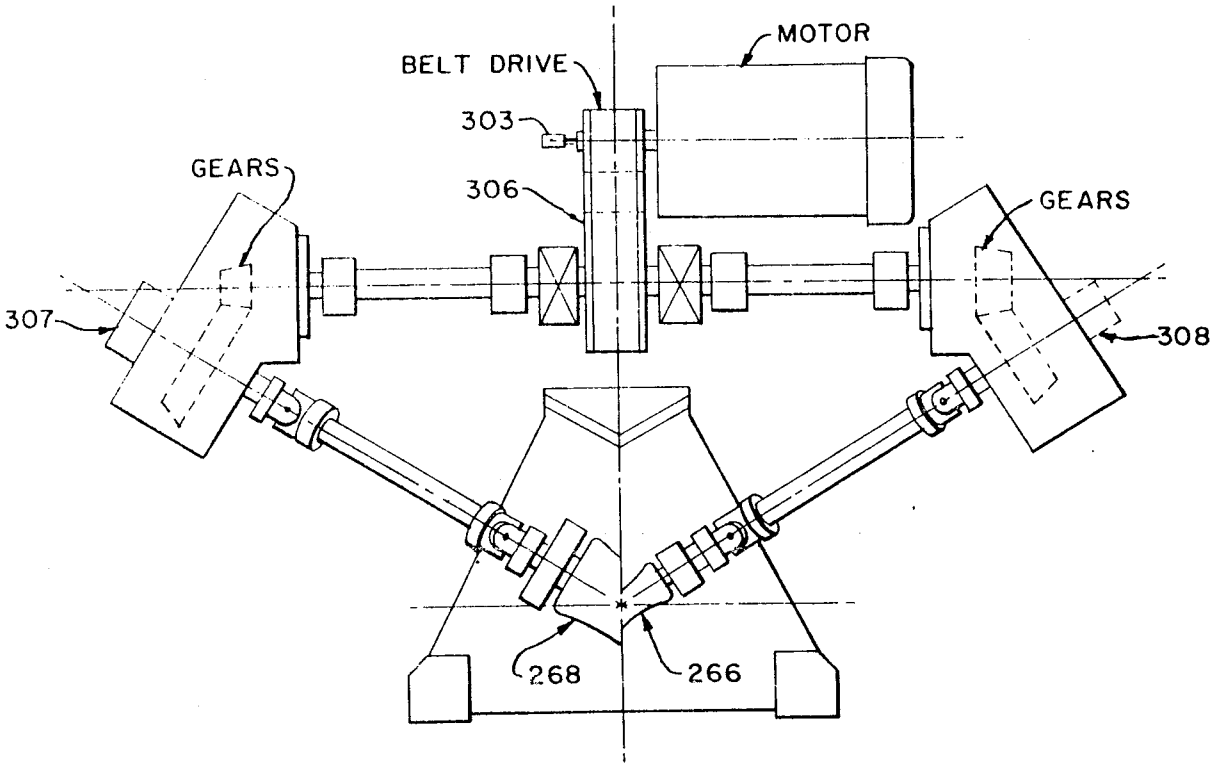
FIG. 32 shows one motor and a geared differential used to drive both of the central rolls.

In a second alternative as shown in FIG. 32, both rolls may be driven through a geared differential 306 in which case the desired roll may be slowed in relation to the other by automatically applying a light braking torque to the desired roll drive. This is done until the stock's leading end has passed the center of the pass. An adjustable sensing device is used to determine when to apply the light braking torque. Since it is difficult to find the right torque it may be advisable to provide an adjustable brake 307 and 308 in each of the drive shafts in order to obtain a satisfactory balance in the peripheral velocities of the two rolls for feeding the stock into the entry end of the pass.

Regardless of which of the above alternatives is used, it may be advisable to use a guide 269 to support the stock in the direction G indicated in FIG. 24. As described above, the stock is forced into the wedge angle $W_0$ at the entry end (not shown) of rolls 266 and 268 by means of speed differential dV, caused by the drag on the larger diameter roll. The stock is supported on the pass line and the larger diameter roll will be driven by the smaller diameter roll until the mentioned sensing device disengages the brake (or brakes). During this time, both rolls will drive the stock forward in rotary motion at substantially equal peripheral speeds until the trailing end leaves the pass. As the trailing end leaves the curved pass it is held in the pass by guide 269. The addition of guide 269 has the additional advantage that, if the stock is not maintained on the pass line, for example the stock diameter is too small for the angle contact, guide 269 will still retain the stock. Since the guide receives very little, if any, wear the material of said guide may be nylon or other material having a low coefficient of friction. A 2-roll straightener such as shown in FIGS. 23 and 24, and described above will therefore straighten stock more efficiently at much higher throughput speeds, and at much less, guide wear, compared to a conventional 2-roll straightener.

In the 2-roll straightener of FIGS. 23 and 24, both rolls are normally driven at substantially equal peripheral velocity, equally sharing the power required to straighten the stock, when it is fully engaged by both rolls. When the stock is thus engaged by both rolls, the smaller diameter male roll 266 will force the stock into the wedge lines of contact at both ends of the roll-pass. The wedge lines of contact are contained in angle $W_0$ of the tangents to same as indicated for the outlet end in FIG. 24. An end view of rolls 266 and 268 taken at the inlet end would be exactly the same; but both rolls would revolve in the opposite, clockwise, direction.

The wedged supports at both ends of the roll-pass makes it difficult to enter the stock into the pass at the entry end. Also, the trailing end of the stock may have tendency to drop out of the last portion of the pass, if the mentioned wedge support opens downwardly and the stock is not supported at the end.

For a so-called horizontal machine, where the stock is flexed in a horizontal direction, and the wedged support angle opens upwardly at the entry end, the leading end of the stock may be dropped into the first portion of the pass. For a vertical machine, however, it should be simpler to enter the stock close to the centerline of the pass.

It should be noted that to those familiar with the art, many other ways of controlling the peripheral velocity of unequal diameter rolls can be developed. For instance, International Harvester has developed a Torque Amplifier with a freewheeling feature, where a lower speed provides the freewheeling feature, while the normal speed will be had by actuating a hydraulic clutch in the planetary speed reducer.

Curved Pass Female Roll Contour

Preferably, the roll pair 70-76 forming a curved pass includes a female roll 70 having a three-section contour that includes an abruptly curved central section that tangents two outer sections. The outer sections are portions of a contour having a less abrupt curvature and a larger throat diameter than the central section. In contrast to the multi-sectional contoured rolls of the prior art, the male and female rolls of the subject invention provide a curved pass for large stock sizes as well as small stock sizes.

Figure 22:
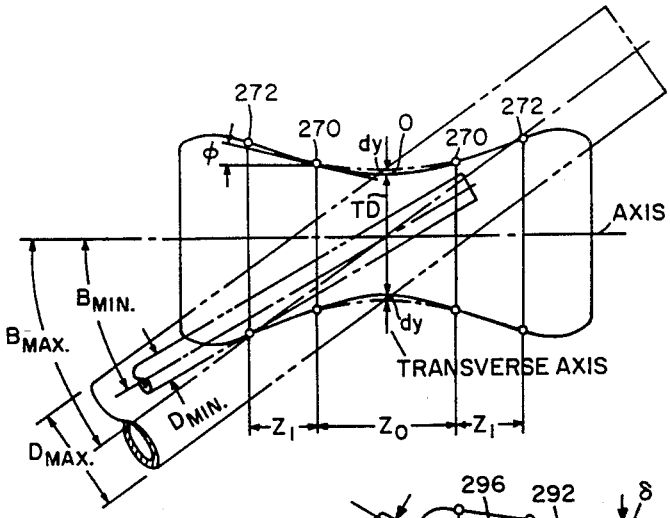
FIG. 22 shows a female roll, used in a curved pass for flexing and straightening round stock.

A female roll having a three-section contour in accordance with the subject invention is shown more specifically in FIG. 22. Contours from points 270 to points 272 extend a length Z, along the axis and are defined by revolving a cylinder around the longitudinal axis of the roll, where the cylinder is spaced a predetermined distance and at a predetermined angle with respect to the longitudinal axis. The surface of the roll's central section 270-0-270 extends a length $Z_0$ but has a sharper curvature. The minimum or "throat" diameter "TD" of the central section is smaller than the minimum diameter defined by extrapolating the curves defining the end contours between points 270 and 272 to the transverse axis of the roll. The end sections and the central section have the same tangents at points 270. When straightening high strength stock, the central curved pass of the subject invention reduces dependence on small roll center-distance in a multi-roll straightener.

The outer contour of roll 70, from points 270 to points 272 forms a concave side of the curved pass for larger sizes of stock and materials of lower strength. The central portion of the roll 70, from point 0 to points 270, forms the concave side of the pass for smaller sizes of high strength stock which requires more abrupt flexure to stress most of the section to or beyond the yield point of the material. When the roll angle is set for the larger stock sizes and lower strength materials, a small gap of clearance over the central portion of roll 70 is left.

Figure 25:
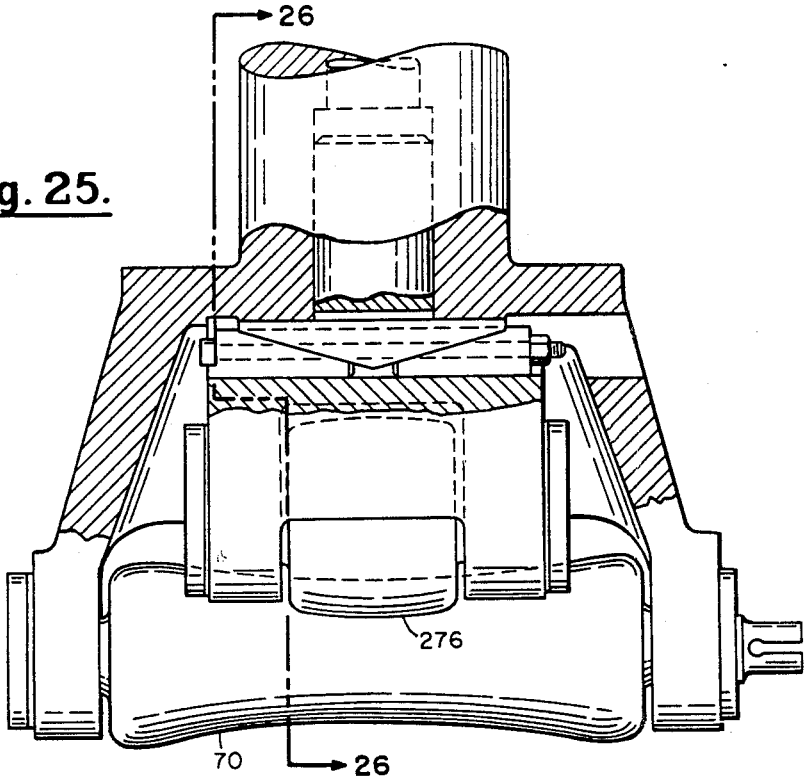
FIGS. 25 and 26 show a roll that is supported against deflection by adjustable back-up rolls.
Figure 26:
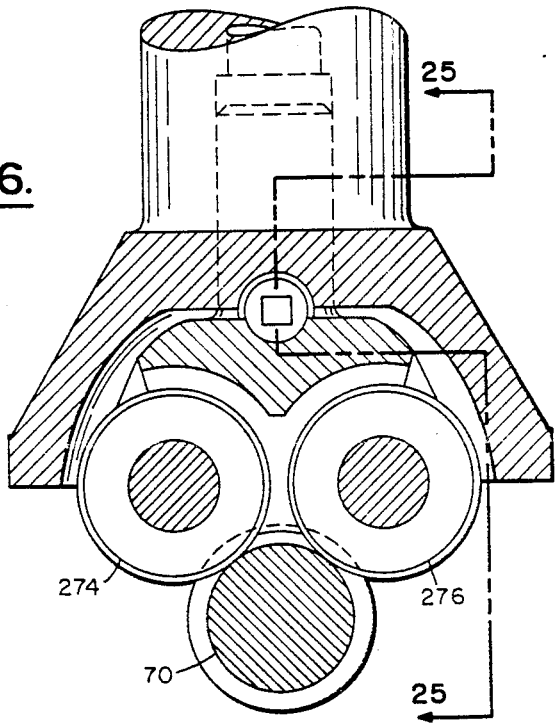

The difference 2dy between the throat diameters of outer contours 270-272 and the central contour 270-0-270 of roll 70 shown in FIG. 22 is relatively small. Where roll 70 is intended to straighten, size and reduce a narrow range of stock sizes at only relatively small changes in roll angles A and B, it may be preferable to omit the central contour 270-0-270. In this case the diameter of roll 70 can be made even smaller. However, where this is done, back-up rolls 274 and 276 as shown in FIGS. 25 and 26 may be required to provide the forces necessary to flex and size the stock. Such back-up rolls may also be required for male roll 266 of FIGS. 23 and 24.

The three section contour of female roll 70 in the curved pass of the subject invention can be used in a 2-roll curved pass straightener, a 3-roll cluster curved pass straightener or as the female roll in a central roll pair of a curved pass multi-roll straightener. The outer sections of the three section contour serve as supports for flexing stock of larger diameters, while the central section provides for more abrupt flexure of smaller diameter stock and higher strength materials. The three-sectional contour for the female roll is advantageous in that the variations required in the roll angles of the opposed working rolls for various stock sizes and materials are substantially lower than in the prior art. Thus, the range of bar and tube sizes and materials that the cross-roll straightener can accommodate is significantly increased.

Figure 27:
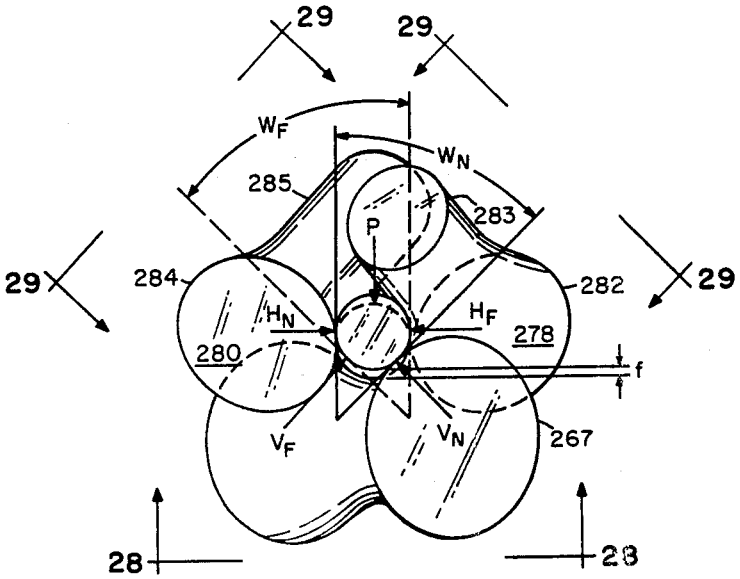
FIGS. 27, 28 and 29 show a 3-roll cluster curved passs that includes one female roll and two opposed male rolls.
Figure 28:
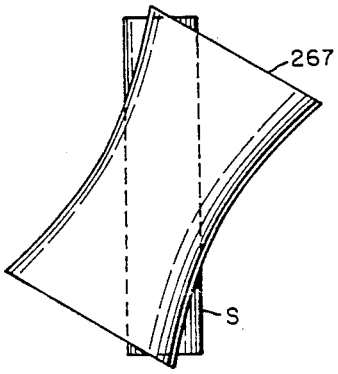
Figure 29:
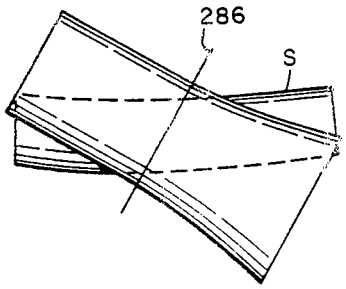

FIGS. 27, 28 and 29 show three-section female roll 267, of a contour similar to roll 70, but of relatively larger diameter described herein as used in combination with a twin roll bending yoke 278 and 280 to form a curved pass three-roll cluster. The three-section contour of female roll 267 substantially increases the flexure capacity of the 3-roll pass comprised of rolls 267, 278 and 280. As shown in FIG. 29, the twin male rolls 278 and 280 each have a male contour half 282 and 284 and a straight, cylindrical half 283 and 285. Twin rolls 278 and 280 are not symmetrical about their transverse axes 286; but are inversely symmetrical in relation to each other and to the stock pass. The stock is flexed into wedge angles $W_N$ and $W_F$ by the male rolls. Alternatively, the cylinder portions 283 and 285 may have a concave contour, less abrupt than bending portions 282 and 284.

The male contour portions 282 and 284 of the bending rolls produce a resultant load P that produces reactions $V_N$ and $H_N$ at the near end of the curved pass and V and H at the opposite end of the curved pass. The bending load forces the stock "S" into wedge angles $W_N$ and $W_F$ at opposite ends of the curved pass between the ends of the female roll 267 and the male contour end of each male roll 278 and 280 as shown in FIGS. 27–29.

Rolls 278 and 280 can be mounted in tiltable brackets similar to that for guide rolls 206 and 208 as shown in FIGS. 20 and 21 having a common support. Rolls 278 and 280 can thereby be vertically adjusted with respect to the stock and are angularly adjustable about a common support centerline. In addition, the vertical angle of rolls 278 and 280 with respect to a horizontal plane can also be adjusted to produce appropriate contact with the stock as it is flexed in the curved pass. As well as forming the bending yoke in a single 3-roll curves pass cluster, a bending yoke comprised of rolls 278 and 280 can also be used between inlet and outlet cross-roll pairs or between conventional three-roll clusters.

Figure 30:
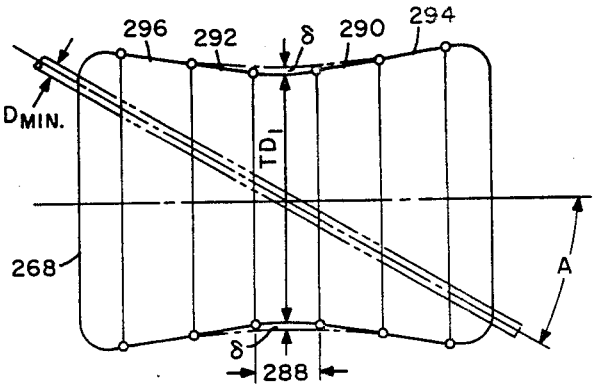
FIG. 30 shows an alternative female roll having five sections.

FIG. 30 shows a bending roll having an even broader operating range than the 3-section working roll of FIG. 22. The bending roll of FIG. 30 has a 5-section roll contour especially suited for straightening a large variety of stock sizes and materials. The contour of the female roll shown in FIG. 30 includes a concave central section 288 that is symmetrical about the roll centerline and the transverse axis and that has a throat diameter $TD_1$. The roll contour further includes a first pair of symmetrically arranged conical frustrums 290 and 292 that tangent the central section at their small ends. The conical frustrums support smaller diameter stock and stock of high material strength as it is flexed into the central section by the male roll. Conical frustrums 290 and 292 make it possible to flex and straighten relatively much smaller stock sizes than with conventional female rolls by substantially increasing the capacity of female roll to support smaller, more abruptly flexed stock sizes. The roll contour further includes a second pair of symmetrical sections 294 and 296 that tangent the conical frustrums 290 and 292 at their large ends. Symmetrical sections 294 and 296 are portions of a concave concave defined by a cylinder disposed at a distance of $\frac{1}{2}TD+\delta$ from the center axis and inclined at a selected angle with respect to the roll axis. Outer sections 294 and 296 have a less abrupt contour than central section 288 to support and straighten larger stock sizes in a curved pass. The throat diameter of the concave roll contour is larger than that of the central section by $2\delta$.

The contour of the disclosed female roll is such that excessive slippage between the rolls and the stock is avoided over a broad range of stock sizes and material strengths. Specifically, the roll angle adjustment of the female roll is substantially the same as the roll angle adjustment for the male roll for different stock sizes and material strengths such that the contact angles of the opposed rolls with the stock is substantially the same.

Also advantageously, the central section of the female roll can be used to round up and size the stock when used in combination with a male roll of suitable contour for compressing the stock. The preferred length at which the stock is compressed is a length that covers the entire surface of the stock as it is rotatingly advanced through the machine. Where sizing and rounding of the stock is not required, the length of central section 288 can be made substantially smaller such that high strength stock of extremely small diameter can be flexed and straightened.

The female roll contours shown in FIGS. 22 and 30 are further preferable for 3-roll single clusters, such as shown in FIG. 27, and especially for the basically 2-roll straightener of the curved pass FIG. 23, where the female roll is of generally larger diameter than the opposed male rolls or roll, respectively; inasmuch as for such opposed rolls it is simpler to calculate the approximate optimum proportion of the larger end diameter to the throat diameter of the opposed female and male rolls. Such proportions should be near the same, where the opposed rolls contact the stock.

Similar to the 3-section female roll of FIG. 22, the 5-section roll of FIG. 30 can be used as the female roll in any cruved pass cross-roll straightener including 2-roll straighteners having a concave female roll opposed by a concave, straight cylindrical, modified cylindrical, or convex roll or with a bending yoke of an opposed pair of asymmetrically mounted male rolls.

In an alternative application for flexing stock, separate controls may be provided for the individual operation of the double acting cylinder 128, FIG. 2. The hollow piston 124 supports the lower adjusting screw 122 and may be used to flex the stock by hydraulic pressure, where operating the screw handwheel and drive cannot produce the force required. Thus, if in setting up the machine, a straight piece of round stock of a certain diameter contacts all rolls 68 to 78, inclusive, and a tube of the same diameter is inserted into the machine in order to straighten same, it must be flexed over roll 76 and contact roll 70. Roll 70 is, therefore, first backed off from the tube a desired amount for flexing the stock. Screw 122 is unscrewed by the same amount in screwbox and yoke 146 while low hydraulic pressure is entered on the upper side of hollow piston 124, thereby keeping roll 76 in the original position. The pressure is now reversed in the hydraulic cylinder forcing the hollow piston, its adjusting screw and attached roll 76, to flex the stock against roll 70. If the amount of flexure is sufficient to stress the stock material slightly beyond its yield point, in the outer fibres of the stock, the rolls may be rotated to feed the stock through the machine thereby straightening the same, and other lengths of stock may be entered into the machine, to be continually flexed and straightened.

It should be noted that roll 70 may be backed off simultaneously with the mentioned hydraulic cylinder moving the hollow piston, its adjusting screw and the attached roll 76, at a slightly higher nominal speed than roll 70; thereby flexing the stock against roll 70 at a speed controlled by the speed of the latter. The advantage of such a procedure is that the stock will be held between rolls 70 and 76 while it is being flexed.

Similarly, in any type of rolling mill apparatus where elongated stock is fed and/or reduced under pressure between rotating rolls, one roll may be automatically retracted to by-pass an obstruction, such as an upset end, a spliced or welded joint of continuously processed stock, and then automatically be brought to bear on the stock at the same pressure and the same adjusted pass opening as previously, by means of sensing devices that control the double acting cylinder backing the adjusting screw, its yoke and roll.

Another alternative embodiment of the invention is an improvement on the conventional 7-roll straightener having two 3-roll end clusters and an intermediate single bending roll, which flexes the stock against a driven, bottom roll in each cluster. The straight pass twin guide rolls may be adjustably arranged opposite the single bending roll to guide the flexed stock under the bending roll into the leaving end pass. Such a pair of adjustable, straight pass, twin rolls provide necessary guidance particularly for smaller stock sizes and upset end tubing. Such twin rolls could also be backed by a double stroke cylinder, similar to the central, lower adjusting screw of FIG. 2. If so, the central cluster could normally contact the main diameter of the tubing and automatically be opened, by retracting the twin guide rolls, for the upset end of the tube to pass, and then automatically close down to normal pass opening, by having sensing devices activating the twin roll backed double acting cylinder.

Still another use of the twin guide rolls would be entering and leaving tables for cross-roll straighteners, piercing mills, reelers, sizing mills and the like.

While certain presently preferred embodiments of the invention have been shown and described and presently preferred methods of practicing the invention have been illustrated, the invention is not limited thereto but may be otherwise variously embodied and practiced within the scope of the following claims.

I claim:

1. A pair of opposed cross-rolls in a machine for straightening round stock uniformly by feeding it forward in rotary motion and flexing it in a curved pass between the pair of cross-rolls, said pair having their longitudinal axes oppositely inclined by substantially equal angles to a plane through a centerline of the flexed stock and a common transverse axis of the rolls, comprising:

a female concave roll as one of the pair of cross-rolls, its contour being symmetrical about the common transverse axis of the rolls;

a male roll as the other of the pair of cross-rolls having a central section, symmetrical about its transverse axis, that flexes an intermediate stock size to a desired substantially constant minimum radius of curvature over a length of stock at least equal to one helix of said stock's forward surface travel and symmetrical about the transverse axis, the sinus of the helix angle being about equal to the cosine of the angle of inclination of the male roll longitudinal axis to the plane through the stock's axis and the transverse axis of the roll pair, the angle being a selected angle for the intermediate size stock, at which angle the male roll contacts the flexed stock, throughout the length of the pass, and the female roll contacts the opposite side of the intermediate stock size at another selected angle of the longitudinal axis of the female roll to said plane; the selected angles being nearly equal.

2. A cross-roll straightener comprising: a central pair of cross-rolls as described in claim 1 forming a curved pass, the rolls being oppositely skewed with respect to the pass line of the cross-roll straightener; and two sets of end rolls forming straight passes, arranged adjacent opposite ends of the central pair, one roll in each set of end rolls having its axis substantially parallel to that of one roll in the central roll pair, and the axes of the rolls in each set of end rolls being substantially equally inclined to the pass line of the cross-roll straightener.

3. A cross-roll straightener as described in claim 2 wherein the sets of end rolls are 3-roll cluster further comprising a means for driving one roll in each cluster as well as one roll in the central roll pair which all have their axes substantially parallel, the driven central roll being a female roll of generally smaller diameter than its opposed male roll.

4. A corss-roll straightener as described in claim 1 further improved by enlarging its capacity as compared to that of conventional straighteners, by varying the length of the main flexure of the stock, by positoning and guiding the stock better, and by reducing the whipping thereof, comprising:

at least one outboard concave roll support adjacent a nonadjustable roll in one set of the end rolls, a means for adjusting the outboard roll support in a plane through and parallel to the transverse axes of the cross-rolls to deflect the stock and a means for rotatably adjusting the outboard roll support about its central axis.

5. A cross-roll straightener as described in claim 4 where the outboard roll support is a twin concave roll assembly.

6. A cross-roll straightener according to claim 4 wherein outboard adjustable concave roll supports are provided adjacent both sets of end rolls for producing reverse flexures of smaller stock sizes, and to guide and reduce the whipping of all stock sizes.

7. A cross-roll straightener as described in claim 4 wherein the outboard roll support consists of:

a single concave roll mounted on the support and at least one adjustable tangential guide substantially parallel to the pass line also mounted on the support.

8. A cross-roll straightener as described in claim 4 wherein the outboard roll support is a twin roll assembly comprising: a pair of substantially concave rolls for supporting round stock, generally inversely arranged about a common transverse axis with respect to each other, removed from a stock pass line, and oppositely inclined to each other and the pass line, each of the rolls having substantially the same concave contour; and a means for mounting the rolls such that the intersection of the transverse and longitudinal axes of each roll is substantially the same distance from a plane through the pass line and orthogonal to the common transverse axis.

9. A twin roll assembly as described in claim 8 wherein the rolls are mounted in separate yokes so that the longitudinal axes of the rolls are contained in substantially parallel planes and tiltable about their transverse axis in opposite directions by substantially equal angles in a common support and rotatably adjustable about a central axis of the support which intersects the transverse axis whereby the rolls when tilted and adjusted about the central axis will support various sizes of stock better.

10. A twin roll assembly as described in claim 9 wherein the rolls are oppositely tiltable by substantially equal angles and wherein the mounting means further comprises: a support; roll yokes with cylindrical bearing surfaces in the support for tiltably maintaining the yokes and rolls therein and means for simultaneously adjusting the roll yokes and rolls as well as maintaining the roll angles after adjustment.

11. A twin roll assembly as described in claim 10 wherein the rolls are inversely arranged with respect to each other about a common transverse axis and the diameter of each roll is smaller at one end than at the other.

12. A cross-roll straightener as described in claim 2, further comprising a main frame and a preloading mechanism for an adjusting screw with respect to a roll yoke support assembly, the preloading mechanism comprising:

an adjusting screw having one end rotatably clamped to a supporting frame and having an opposite end that is exteriorly threaded but with a hole and interiorly threaded portion of the same pitch and hand as the exteriorly threaded portion;

a yoke that carries the assembly, the yoke having a screw box engaging the exteriorly threaded end of the screw whereby the yoke and a screw box are moved with respect to the frame by rotation of the adjusting screw;

a retainer that is fastened to the yoke at the opposite end of the screw box;

a smaller diameter screw that fits the interiorly threaded portion of the adjusting screw at one end and is resiliently but nonrotatingly held in the retainer; and a means for tensioning the smaller diameter screw and a portion of the adjusting screw suvh that one side of the threads in the screw box is held firmly against the adjacent side of the external threads of the adjusting screw, thus preventing sagging of the yoke when not under load.

13. A cross-roll straightener as described in claim 2 further comprising a main frame and a means for supporting at least one of the rolls in the main frame comprising:

a hydraulic cylinder attached to the frame;

a piston seated within the cylinder, the piston yielding above a predetermined pressure;

a piston rod having one end connected to the piston;

a holder that is threadingly attached to the distal end of the piston rod;

a thrust bearing mounted on the holder;

a yoke connected to the thrust bearing such that the yoke is rotatable with respect to the holder and piston rod; and a roll bracket for rotatingly maintaining the roll connected to the yoke.

14. A cross-roll straightener as described in claim 2 further comprising a main frame and a central roll support that yields at a selected pressure comprising:

a roll support for the roll assembly;

a hydraulic piston head maintained within a bore in the frame, one end of the bore having a seat that limits the travel of the piston head in one direction, the piston having a first bore and a second bore that is of smaller diameter than the first bore, the first and second bores being arranged to form a seat therebetween;

an adjusting screw having one end that threadingly engages the roll support and an opposite end that is rotatably clamped in the second bore of the piston head, the adjusting screw being rotatably supported by the seat between said first and second bores;

a retainer fastened at the other end of the frame bore to limit the travel of the piston head in the opposite direction; and a hydraulic means for maintaining the piston head against the retainer under an established pressure such that the postion of the roll with respect to the frame is controlled by rotation of the adjusting screw, the hydraulic means yielding at pressures above the established pressure such that the piston moves toward the seat in the bore.

15. A cross-roll straightener as described in claim 14 wherein the hydraulic means selectively applies controlled pressure to either side of the hydraulic piston head such that the position of the roll with respect to the frame is controlled by selectively controlling the hydraulic flow and pressure.

16. A cross-roll straightener as described in claim 2 further comprising:

a main frame, two sets of end rolls which are pairs of opposed cross-rolls, arranged adjacent opposite ends of the central pair, the rolls of the two pairs being oppositedly skewed with respect to the pass line of the cross-roll straightener such that the central pair of rolls and the two adjacent pairs of rolls have their transverse axes substantially in a common plane for feeding round stock forward in rotary motion, the central pair of which is laterally adjustable in relation to the other roll pairs for flexing the stock in said common plane;

a drive means for the three pairs of cross-rolls comprising: at least two motors and a gear box for the three rolls on each side of the stock, the gear box and three rolls connected by spindles driven from straight faced gears inthe gear box; at least one motor mounted on one side of the spindles and one on the other side of the spindles and having their shafts parallel with the shafts of the gears; and the front end of each motor facing the driven end of its respective rolls.

17. A drive for a 6-roll straightener as described in claim 16 having three pairs of cross-rolls for moving stock forward in rotary motion and flexing the same by adjusting a central roll pair laterally in relation to the passline in the end roll pairs comprising:

two gear drives each having three output shafts and spindles driven by at least two variable speed motors, one for each gear drive driving the central roll pair consisting of male and female bending rolls, the male roll driving motor being of higher capacity than the female roll driving motor and wherein all the motors have their front ends facing the driven ends of the rolls, their shafts being parallel to one another.

18. A cross-roll straightener as described in claim 2 having two pairs of opposed rolls arranged adjacent opposite ends of the central roll pair, the rolls of the adjacent pairs as well as the central roll pair being oppositely skewed with respect to the pass line of the cross-roll straightener comprising:

roll neck bearings for rotatingly maintaining the neck portions of each roll; and a bracket for supporting the roll neck bearings in inverse symmetry about a longitudinal axis of the roll such that the bearings are substantially supported both laterally and vertically in response to straightening loads applied to the roll.

19. In a pair of cross-rolls as described in claim 1 wherein the female roll has a compound contour symmetrical about its transverse axis, comprising:

a central section having a concave surface that is substantially defined by rotation of the roll with respect to a round rod flexed in a plane through the roll's transverse axis symmetrically about the transverse axis, located at a predetermined distance and at a selected angle with respect to the longitudinal axis of said female roll;

two intermediate sections in the shape of equal length frustums that abut and tangent the outer ends of the central section at the small ends thereof; and two end sections that abut and tangent the outer ends of the intermediate sections, the end sections being the outer portions of a concave roll symmetrical about the roll's transverse axis substantially defined by rotation of the roll with respect to an intermediate stock size rod flexed in a plane through the transverse axis, located at a larger distance and a smaller angle with respect to the longitudinal axis of the female roll than for the first mentioned rod, the central and intermediate sections providing support for flexing smaller stock sizes and stock of high strength materials.

20. A cross-roll straightener having at least one pair of cross-rolls as described in claim 1, further comprising a main frame comprising:

a frame having extending arms that are integrally connected thereto;

a main opposed frame having extending arms that are integrally connected thereto, the extending arms of the frames opposing each other such that a junction is formed between the ends of the respective ends of the frame arms approximately midway between them; and a means for connecting the opposing ends of the frame arms at the junction thereof, including at least one positioning member in at least two of the connected amrs of each frame.

* * * * *

UNITED STATES PATENT AND TRADEMARK OFFICE

CERTIFICATE OF CORRECTION

PATENT NO. : 4,763,504

DATED : August 16, 1988

INVENTOR(S) : Einar W. Nilsson

It is certified that error appears in the above—identified patent and that said Letters Patent is hereby corrected as shown below:

Column 1, line 7: delete --4,711,172-- and substitute "4,711,112" therefor.
Column 2, line 35: delete --6roll-- and substitute "6-roll" therefor.
Column 3, line 2: delete --crossroll-- and substitute "cross-roll" therefor.
Column 3, line 47: delete --somewaht-- and substitute "somewhat" therefor.
Column 3, line 53: delete --bearing-- and substitute "bearings" therefor.
Column 4, line 2: insert the word "a" before "female".
Column 4, line 53: insert the word "a" before "generally".
Column 4, line 61: delete --two-roll-- and substitute "twin-roll" therefor.
Column 6, lines 67-68: delete --FIG. 33 is another view of the embodiment illustrated in FIG. 32.--.
Column 7, line 24: delete --52-14 60, 54-14 62 and 56-14 64-- and substitute "52-60, 54-62 and 56-64" therefor.
Column 7, line 31: delete --cuased-- and substitute "caused" therefor.
Column 8, line 50: delete --outof-round-- and substitute "out-of-round" therefor.
Column 8, line 56: insert "under hydraulic pressure at cavity 128. Hollow piston 124" after "126".
Column 9, line 32: delete --to-- and substitute "To" therefor.
Column 9, line 48: delete --the-- after "in".
Column 11, line 25: insert "to" after "adjusted".
Column 11, line 68: delete --shown-- and substitute "known" therefor.

UNITED STATES PATENT AND TRADEMARK OFFICE

CERTIFICATE OF CORRECTION

PATENT NO. : 4,763,504

DATED : August 16, 1988

INVENTOR(S) : Einar W. Nilsson

It is certified that error appears in the above—identified patent and that said Letters Patent is hereby corrected as shown below:

Column 13, line 3: delete --dirve-- and substitute "drive" therefor.
Column 13, line 10: delete --with-- and substitute "will" therefor.
Column 13, line 28: delete --209-- and substitute "208" therefor.
Column 14, line 34: delete --fulll-- and substitute "full" therefor.
Column 19, line 27: insert "the" before "female".
Column 19, line 32: delete --concave concave-- and substitute "concave contour" therefor.
Column 20, line 5: delete --cruved-- and substitute "curved" therefor.
Column 21, line 55: delete --cluster-- and substitute "clusters" therefor.
Column 21, line 61: delete --corss-roll-- and substitute "cross-roll" therefor; delete "1" and substitute "2" therefor.
Column 21, line 64: delete --positoning-- and substitute "positioning" therefor.

UNITED STATES PATENT AND TRADEMARK OFFICE

CERTIFICATE OF CORRECTION

PATENT NO. : 4,763,504

DATED : August 16, 1988

INVENTOR(S) : Einar W. Nilsson

It is certified that error appears in the above-identified patent and that said Letters Patent is hereby corrected as shown below:

Column 23, line 10: delete --suvh-- and substitute "such" therefor.

Column 23, line 53: delete --postion-- and substitute "position" therefor.

Column 24, lines 1-2: delete --opposit-edly-- and substitute "oppositely" therefor.

Column 24, line 14: delete --inthe-- and substitute "in the" therefor.

Signed and Sealed this

Eighth Day of August, 1989

*Attest:*

DONALD J. QUIGG

*Attesting Officer*

*Commissioner of Patents and Trademarks*